US010293241B2

(12) United States Patent
Rodrick et al.

(10) Patent No.: US 10,293,241 B2
(45) Date of Patent: May 21, 2019

(54) CATCHER'S LEG GUARD

(71) Applicant: Ampac Enterprises Inc., Shirley, MA (US)

(72) Inventors: Austin Rodrick, Shirley, MA (US); Stanley Jurga, Jr., Shirley, MA (US); Brad Jurga, Shirley, MA (US); Ya Chi Chen, New Taipei (TW); Shyan Wei Chen, New Taipei (TW)

(73) Assignee: Ampac Enterprises Inc., Shirley, MA (US)

( * ) Notice: Subject to any disclaimer, the term of this patent is extended or adjusted under 35 U.S.C. 154(b) by 171 days.

(21) Appl. No.: 15/595,347

(22) Filed: May 15, 2017

(65) Prior Publication Data

US 2018/0326290 A1 Nov. 15, 2018

(51) Int. Cl.

| | |
|---|---|
| ***A63B 71/12*** | (2006.01) |
| ***A41D 13/05*** | (2006.01) |
| ***A41D 13/015*** | (2006.01) |

(52) U.S. Cl.

CPC ..... *A63B 71/1225* (2013.01); *A41D 13/0153* (2013.01); *A41D 13/0543* (2013.01); *A63B 2071/125* (2013.01); *A63B 2071/1241* (2013.01); *A63B 2071/1258* (2013.01)

(58) Field of Classification Search

CPC .. A41D 13/0543; A41D 13/06; A41D 13/065; A41D 13/0568; A41D 13/0153; A63B 71/1225; A63B 2071/125; A63B 2071/1258; A63B 2071/1275; A63B 2071/1283; A63B 2071/1241

See application file for complete search history.

(56) References Cited

U.S. PATENT DOCUMENTS

| | | | | | |
|---|---|---|---|---|---|
| 4,674,157 | A * | 6/1987 | Litz | A63B 71/1225 | 2/22 |
| 4,692,946 | A * | 9/1987 | Jurga | A63B 71/1225 | 2/22 |
| 5,452,475 | A * | 9/1995 | Hunt, Jr. | A63B 71/1225 | 2/22 |
| 6,128,779 | A * | 10/2000 | Goldsmith | A41D 13/065 | 2/22 |
| 6,178,556 | B1 * | 1/2001 | Foreman | A63B 71/08 | 128/882 |

(Continued)

*Primary Examiner* — Amy Vanatta

(74) *Attorney, Agent, or Firm* — Bradley Arant Boult Cummings LLP

(57) ABSTRACT

The present invention is directed to a leg guard that provides increased protection while also providing maximum articulation and increased freedom of movement for the user. More particularly, the leg guard includes a toe guard, a shin guard, a knee guard including an extended knee cap wrap, an extended knee guard, a thigh guard, a left hinge, and a right hinge. Through the use of an extended knee cap wrap and a hinged configuration, the leg guard provides additional protection for the knees of a catcher and allows catchers to freely and quickly move to or through different stances without having to re-position the pads of the leg guard. The hinged configuration provides enhanced mobility for the user by preventing the leg guard from shifting and rotating about the shin of the user and allowing the leg guard to remain static without axial rotation or vertical movement.

21 Claims, 16 Drawing Sheets

(56) References Cited

U.S. PATENT DOCUMENTS

| | | | | |
|---|---|---|---|---|
| 6,964,062 | B1 * | 11/2005 | Chen | A41D 13/065 2/22 |
| 2002/0184693 | A1 * | 12/2002 | Beland | A63B 71/1225 2/22 |
| 2003/0154540 | A1 * | 8/2003 | Nishimoto | A63B 71/1225 2/220 |
| 2004/0083527 | A1 * | 5/2004 | Budda | A41D 13/0568 2/22 |
| 2005/0246812 | A1 * | 11/2005 | Bevier | A63B 71/1225 2/22 |
| 2006/0167396 | A1 * | 7/2006 | Berger | A63B 71/1225 602/23 |
| 2007/0250977 | A1 * | 11/2007 | Brown | A41D 13/0543 2/22 |
| 2008/0178360 | A1 * | 7/2008 | Nascimento | A63B 71/1225 2/22 |

* cited by examiner

CATCHER'S LEG GUARD

FIELD OF THE INVENTION

The present invention relates generally to sports equipment. In particular, the present invention relates to a leg guard for a baseball or softball catcher.

BACKGROUND OF THE INVENTION

Baseball and softball catchers are positioned behind home plate and perform many important functions during a game, from calling plays and protecting the plate to catching the ball thrown by the pitcher. Due to impacts from pitches, sometimes in excess of 90 mph, and home plate crashes with other players, the bodies of catchers are regularly exposed to physical trauma.

One particular physical injury that catchers are especially prone to is knee injuries. Due to the crouching position catchers assume behind home plate, catchers commonly injure their knees. For instance, the crouching position exposes the inner legs of a catcher to impacts from pitches. Because of this exposure, the inner side portions of a catcher's knees are often struck by the ball. Collisions at home plate from opposing team players trying to score also often result in slides that impact or injure the catcher's lower legs and knees. These types of injuries can seriously hinder the catcher's ability to perform vital functions during the game.

Current leg guards exist that provide some protection to the knee, thigh, and shin areas. Existing leg guards typically include a triple kneecap design, where three separate protective paddings come together to cover and protect the knee. For example, U.S. Pat. No. 4,692,946 to Jurga describes a triple kneecap design where a pair of flexible straps is utilized to secure the knee guard, first thigh guard, and second thigh guard to each other. The leg guards usually include additional protective padding to protect the thigh and shin portions of the leg. However, existing triple kneecap designs do not provide sufficient protection for the inner side portions of a catcher's knees.

In addition, a catcher's blocking motions for stopping wild pitches requires that the catcher drop quickly onto their knees from the crouching position and just as quickly either reassume the crouching position or stand upright to throw out any potential base stealers. In doing so, the pads of the catcher's leg guard often become misaligned and mispositioned. For instance, when a catcher assumes the crouching position, the leg guard slides down the leg of the catcher about 3 inches. However, when the catcher reassumes a standing upright position from the crouching position, the leg guard does not slide back up into place to protect the thigh. Not only can this be distracting to the catcher, but it also requires the catcher to quickly reposition and align the pads.

While catchers have been provided with equipment to protect their bodies from these various stresses, there still remains a need for a leg guard that more adequately protects the catcher's knees and allows catchers to freely and quickly move to or through different stances without having to re-position the pads of the leg guard.

SUMMARY OF THE INVENTION

The present invention is directed to a leg guard including a toe guard having a first cover shell and a first cushion pad affixed to a bottom side of the first cover shell, a shin guard having a second cover shell and a second cushion pad affixed to a bottom side of the second cover shell, wherein the shin guard is attached to and positioned in vertical alignment with the toe guard, a knee guard having a third cover shell and a third cushion pad affixed to a bottom side of the third cover shell, wherein the knee guard is attached to and positioned in vertical alignment with the shin guard, a thigh guard having a fourth cover shell and a fourth cushion pad affixed to a bottom side of the fourth cover shell, a left hinge and a right hinge, wherein the left and right hinges operatively connect the thigh guard to the knee guard, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, and a strapping system configured to removably and adjustably attach the leg guard.

In one embodiment, the left and right hinges each include a first end and a second end, and each of the first ends is formed integrally with the fourth cover shell and each of the second ends is removably attached to the third cover shell. In another embodiment, the left and right hinges each include a first end and a second end, and each of the first ends is removably attached to the fourth cover shell and each of the second ends is removably attached to the third cover shell. In yet another embodiment, the fourth cover shell includes a left edge and a right edge, the left and right edges each including a symmetrical indentation. The symmetrical indentation may be angular, V-shaped, U-shaped, or rectangular. In still another embodiment, the fourth cover shell includes a left edge and a right edge, and one of the left or right edges includes an angular, V-shaped, U-shaped, or rectangular indentation.

In another embodiment, the thigh guard is configured to articulate less than 90 degrees relative to the knee guard upon movement of the user to a crouching position, and wherein the thigh guard is configured to articulate without a change in axial rotation or vertical displacement about a user's leg. In yet another embodiment, the fifth cushion pad may include a tube-like fastener affixed to a bottom portion of the fifth cushion pad, wherein the tube-like fastener is configured to receive an elastic band, the elastic band including two ends, and wherein each of the ends of the elastic band are operatively attached to the fourth cover shell. In still another embodiment, the strapping system further includes a thigh strap, the thigh strap including a first section having a first width and a second section having a second width, wherein the first section is configured to secure a thigh of a user and the first width is greater than the second width. In this aspect, the first width is about 1.5 inches to about 2 inches.

The present invention also relates to a leg guard including toe guard having a first cover shell and a first cushion pad affixed to a bottom side of the first cover shell, a shin guard having a second cover shell and a second cushion pad affixed to a bottom side of the second cover shell, wherein the shin guard is attached to the toe guard by an ankle extension and the shin guard is positioned in vertical alignment with the toe guard, a knee guard having a third cover shell and a third cushion pad affixed to a bottom side of the third cover shell, the third cover shell further including an extended left side portion and an extended right side portion, wherein the extended left and right side portions are dimensioned to substantially cover lateral portions of a user's knee, and wherein the knee guard is attached to and positioned in vertical alignment with the shin guard, a thigh guard having a fourth cover shell and a fourth cushion pad affixed to a bottom side of the fourth cover shell, wherein the fourth cover shell includes a left hinge and a right hinge, the left and right hinges each including a first end and a second end, wherein each of the first ends is formed integrally with the fourth cover shell and each of the second ends is removably attached to the third cover shell at a lower pivot point, each of the lower pivot points may be positioned at an upper edge of the extended left and right side portions, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, a strapping system configured to removably and adjustably attach the leg guard to a user, and the knee guard, thigh guard, and extended knee guard are adapted to pivot upon movement of the user through a plurality of positions. For example, the knee guard, thigh guard, and extended knee guard are adapted to pivot with a change in axial rotation of less than 10 degrees about the user's leg and a change in vertical movement of less than 10 percent about the user's leg from an original position.

In one embodiment, the extended left and right side portions are configured to form an angle of about 85 degrees to about 100 degrees relative to a front portion of the third cover shell. In another embodiment, the leg guard may further include an inner knee pad detachably and adjustably fastened to a bottom side of the third cushion pad.

In this aspect, the extended knee guard may be attached to the thigh guard by at least two top straps, wherein one end of each top strap is secured to the fourth cover shell and the other end of each top strap is secured between an upper portion of the fifth cover shell and the fifth cushion pad. In another embodiment, the extended knee guard is attached to the knee guard by at least two bottom straps, wherein one end of each bottom strap is secured to the third cover shell and the other end of each bottom strap is secured between a lower portion of the fifth cover shell and the fifth cushion pad.

The present invention further relates to a leg guard including a toe guard having a first cover shell and a first cushion pad affixed to a bottom side of the first cover shell, a shin guard having a second cover shell and a second cushion pad affixed to a bottom side of the second cover shell, wherein the shin guard is attached to the knee guard by an ankle extension and the shin guard is positioned in vertical alignment with the toe guard, a knee guard having a third cover shell and a third cushion pad affixed to a bottom side of the third cover shell, the third cover shell further including an extended left side portion and an extended right side portion, wherein the extended left and right side portions are dimensioned to substantially cover lateral portions of a user's knee, and wherein the knee guard is attached to and positioned in vertical alignment with the shin guard, a thigh guard having a fourth cover shell and a fourth cushion pad affixed to a bottom side of the fourth cover shell, wherein the fourth cover shell includes a left hinge and a right hinge, the left and right hinges each including a first end and a second end, wherein each of the first ends is formed integrally with the fourth cover shell and each of the second ends is removably and adjustably attached to the third cover shell at a lower pivot point, wherein the third cover shell includes at least one slot on each of the extended left and right side portions configured for receiving each of the second ends, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, a strapping system configured to removably and adjustably attach the leg guard to a user, and wherein the knee guard, thigh guard, and extended knee guard are configured to pivot without a change in axial rotation or vertical displacement upon movement of the user through a plurality of positions.

In one embodiment, the third cover shell includes a plurality of circular slots on each of the extended left and right side portions configured for receiving each of the second ends. In another embodiment, the third cover shell includes an elongated slot on each of the extended left and right side portions configured for adjustably receiving each of the second ends.

In still another embodiment, each of the second ends is removably attached by rivets, rubber bushings, pins, t-nuts, screws, binding barrels, or press fits. In yet another embodiment, the left and right hinges are formed from elastomers, cast or injected metal, rubber, carbon fiber, glass composite, co-molded materials, or two-shot injection molded materials.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The present invention is directed to a leg guard that provides increased protection while also providing maximum articulation and increased freedom of movement for the user. More particularly, through the use of an extended knee cap wrap and a hinged configuration, the leg guard of the present invention provides additional protection for the knees of a catcher and allows catchers to freely and quickly move to or through different stances without having to re-position the pads of the leg guard. The hinged configuration described by the present invention provides enhanced mobility for the user by preventing the leg guard from shifting and rotating about the shin of the user and allowing the leg guard to remain static without axial rotation or vertical movement.

Figure 1:
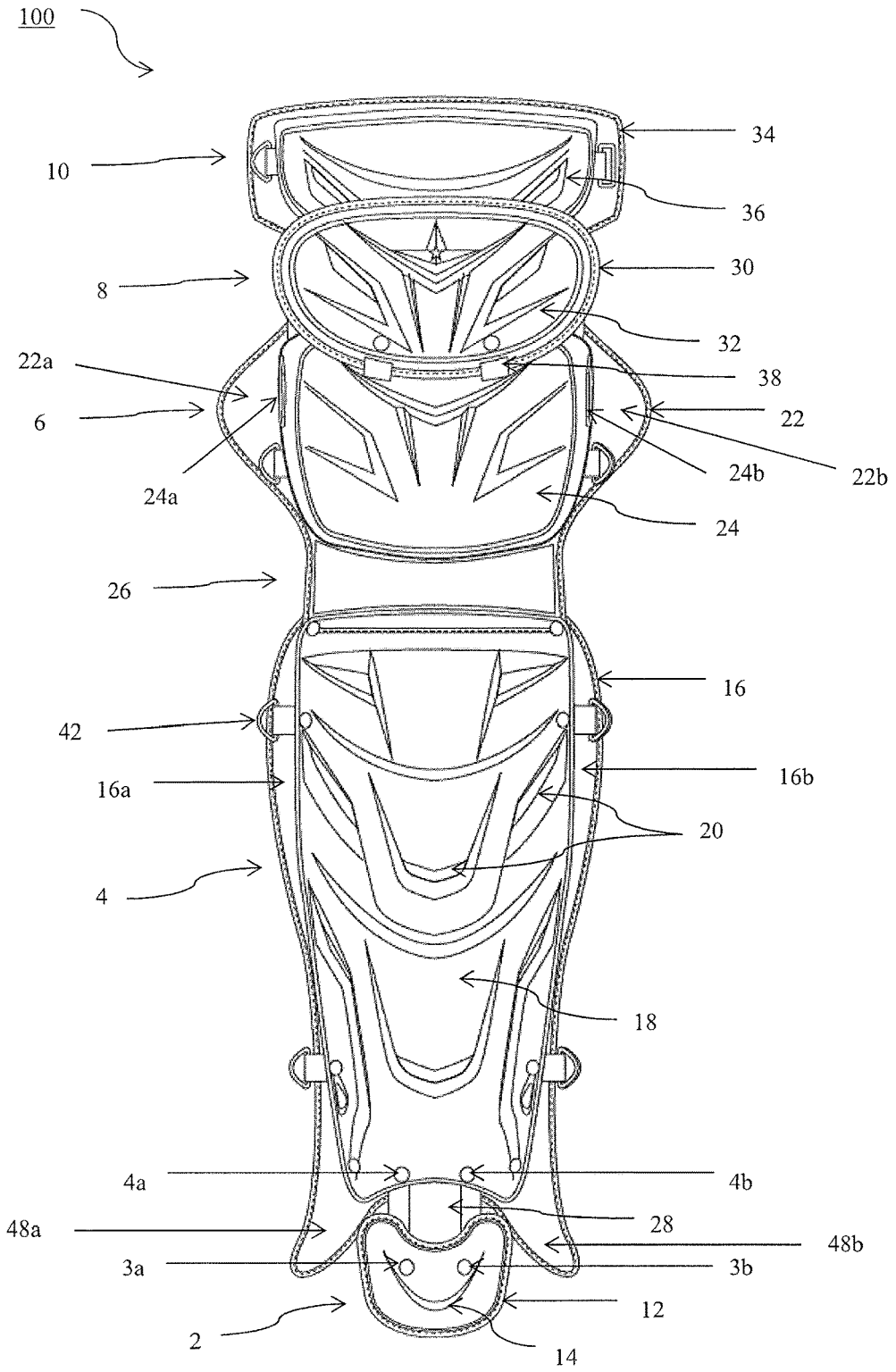
FIG. 1 shows a schematic front view of a leg guard according to the present invention.

Referring to FIG. 1, a leg guard in accordance with the present invention is shown. The leg guard 100 includes a toe guard 2, a shin guard 4, a knee guard 6, an extended knee guard 8, a thigh guard 10, and a knee-protecting pad portion 26. The leg guard also includes a plurality of loops 42 to which one or more straps (not shown) may be fastened. The leg guard of the present invention is suitable for both adults and youths. As will be apparent to one of ordinary skill in the art, the design and dimensions of a youth version of the leg guard according to the present invention is proportional to an adult version of the leg guard according to the present invention.

The toe guard 2 includes a cushion pad 12. The toe guard 2 also includes a cover shell 14 that covers the cushion pad 12 and is affixed thereto. While FIG. 1 shows stitching of the cover shell 14 to the cushion pad 12, the affixation of the cover shell to the cushion pad may occur in any manner that results in a semi-permanent or permanent attachment between the cover shell 14 and the cushion pad 12. For example, the cover shell 14 may be affixed atop the cushion pad 12 with rivets, fasteners, stitching, or a combination thereof.

In one embodiment, the toe guard 2 is shaped to cover and fit around the top portion of the user's foot. The toe guard 2 may be contoured to follow the contour typical of the top portion of the foot of a user. In another embodiment, toe guard 2 may be flexible or articulated such that the toe guard does not remain in a fixed position.

In order to accommodate the extreme angle of the ankle joint while the user is in a crouching or upright position, the toe guard 2 is connected to the shin guard 4 via an ankle extension 28. In one embodiment, the ankle extension 28 is a separate component with one end connected to the shin guard 4 and the other end to toe guard 2. More specifically, the ankle extension 28 may be disposed between the cover shell 14 and the cushion pad 12 of the toe guard 2 and between the cover shell 18 and cushion pad 16 of the shin guard 4. In one embodiment, the ankle extension 28 is attached to the toe guard 2 and shin guard 4 with rivets 3*a*, 3*b* and 4*a*, 4*b*, respectively. In another embodiment, the ankle extension 28 may be formed integrally with the shin guard 4, the toe guard 2, or both guards. The ankle extension may be formed from a variety of materials, including materials used to form any of the cushion pads discussed herein.

The shin guard 4 includes a cushion pad 16 and a cover shell 18 that covers the cushion pad 16 and is affixed thereto. While FIG. 1 shows stitching of the cover shell 18 to the cushion pad 16, the affixation of the cover shell 18 to the cushion pad 16 may occur in any manner that results in a semi-permanent or permanent attachment between the cover shell 18 and the cushion pad 16. For example, the cover shell 18 may be affixed atop the cushion pad 16 with rivets, fasteners, stitching, or a combination thereof. In addition, the affixation of the cover shell 18 to the cushion pad 16 may be discontinuous or continuous. For example, as shown in FIG. 1, the stitching along the top of the cover shell 18 is not connected to the stitching along the sides of the cover shell 18.

Figure 2:
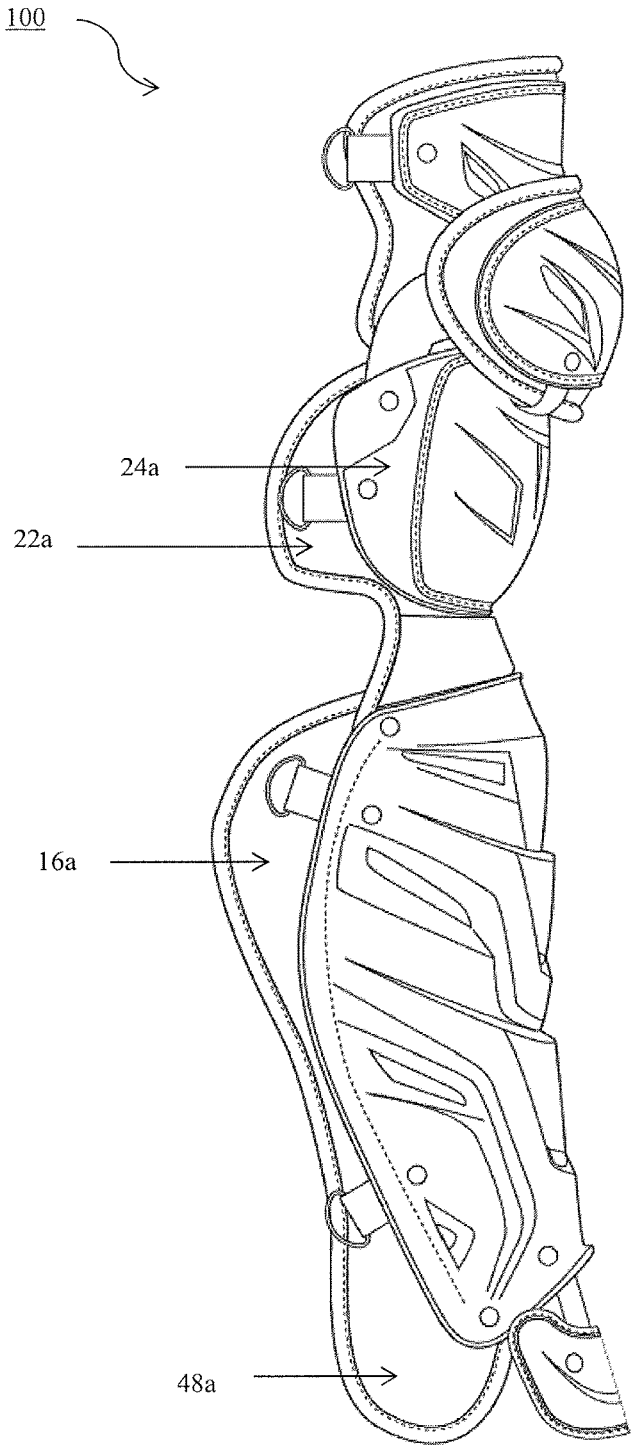
FIG. 2 shows a schematic side view of the leg guard according to FIG. 1.

The cushion pad 16 and cover shell 18 are both contoured to follow the contour typical of the shin portion of the leg of a user. This contouring provides for a more comfortable fit. In one embodiment, cushion pad 16 may include flexible winged side panels 16*a*, 16*b* for additional protection for the side of the user's leg. For instance, FIG. 2 shows a side view of the left flexible winged side panel 16*a*. As can be seen from FIG. 2, the side panels 16*a*, 16*b* shield the side of the user's leg from impact. In another embodiment, cushion pad 16 may include ankle guards 48*a*, 48*b*. As shown in FIG. 1, ankle guards 48*a*, 48*b* are lower side panels of cushion pad 16 that provide additional protection for the sides of the user's ankle. FIG. 2 shows a side view of the left ankle guard 48*a*. As demonstrated by FIG. 2, the ankle guards 48*a*, 48*b* shield the user's ankles from impact.

Figure 3:
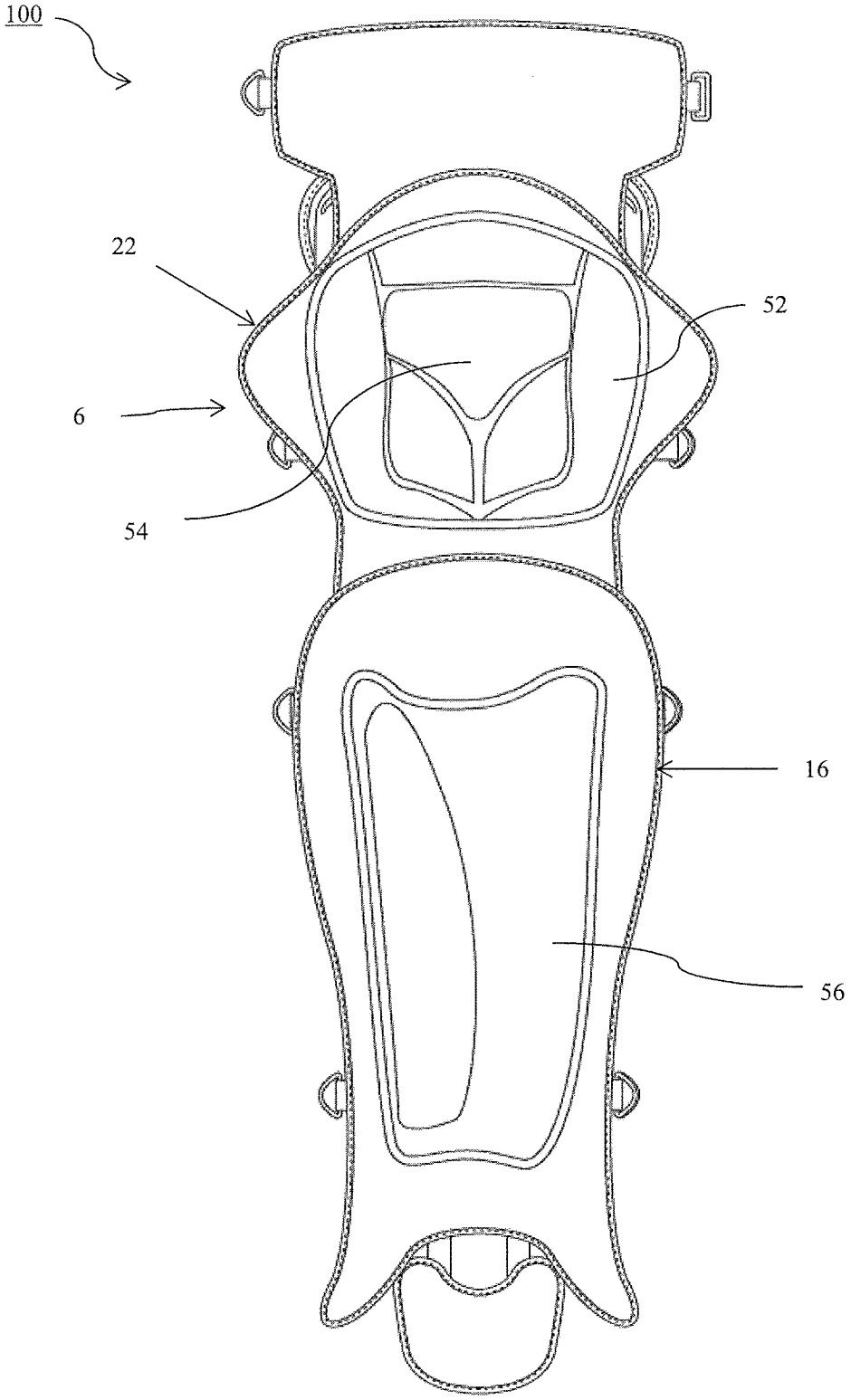
FIG. 3 shows a schematic rear view of a leg guard according to the present invention.

For extra protection and support along the shin portion of the user's leg, the shin guard 4 may include additional padding. For instance, the cushion pad 16 may further include an inner shin pad 56 (as shown in FIG. 3). The inner shin pad 56 may be detachably and adjustably fastened to the inside of the cushion pad 16. For instance, the inner shin pad 56 may be removably attached to cushion pad 16 with hook-and-loop closures, such as Velcro®, snaps, clips, or the like. The inner shin pad 56 may be formed of open cell polyurethane, EVA foam, memory foam, gel impact pads, and a variety of other padding materials that protect the shin from impact. The inner shin pad 56 may also be formed from a combination of any of the above-discussed padding materials.

The cover shell 18 may include a plurality of air vents 20 that extend through the cover shell 18 to allow for ventilation and expelling of sweat. The positioning and quantity of air vents 20 are not limited. For instance, the cover shell 18 may include a plurality of air vents 20 along the median of the shell, the lateral sides of the shell, or any combinations thereof. As shown in FIG. 1, a plurality of air vents 20 may be positioned along the left and right sides of the cover shell 18 as well as along the median.

The knee guard 6 includes a cushion pad 22 and a cover shell 24 that covers the cushion pad 22 and is affixed thereto. In one embodiment, cushion pad 22 may include flexible side panels 22*a*, 22*b* for additional protection for the sides of the user's knee. FIG. 2 shows a side view of the left side panel 22*a*. As demonstrated by FIG. 2, side panels 22*a*, 22*b* provide additional cushioning protection for the sides of the user's knee. While FIG. 1 shows stitching of the cover shell 24 to the cushion pad 22, the affixation of the cover shell 24 to the cushion pad 22 may occur in any manner that results in a semi-pennanent or permanent attachment between the cover shell 24 and the cushion pad 22. For example, the cover shell 24 may be affixed atop the cushion pad 22 with rivets, fasteners, stitching, or a combination thereof. The cover shell 18 of the shin guard 4 has a top side thereof affixed to cushion pad 22 of the knee guard 6.

In one embodiment of the present invention, a gap between the upper edge of the shin guard 4 and a lower edge of the knee guard 6 is spanned by a knee-protecting pad portion 26. The knee-protecting pad portion 26 provides a layer of padding that covers a lower portion of the cushion pad 22 of the knee guard 6. That is, the gap between the knee guard 6 and the shin guard 4 is composed of two layers: a top layer of padding (the knee-protecting pad portion 26) and a bottom layer of cushioning (the lower portion of the cushion pad 22). The knee-protecting pad portion 26 may be secured to the cushion pad 22 by any suitable means including, but not limited to, adhesives, sewing, or stitching.

According to the present invention, the cover shell 24 of knee guard 6 covers not only the kneecap portion of the leg, but also extends to cover a significant portion of the lateral sides of the knee. That is, the cover shell 24 is shaped as a round, extended bowl so that the cover shell 24 wraps around the knee and protects both the kneecap and the lateral sides of the knee. Indeed, cover shell 24 fully covers the front and sides of a user's knee through a full range of motion. In this aspect, the cover shell 24 includes an extended left side portion 24*a* and an extended right side portion 24*b* that wrap around the knee of the user and cover the sides of a user's knee. FIG. 2 shows a side view of the extended left side portion 24*a* of cover shell 24. As demonstrated by FIG. 2, the extended side portions 24*a*, 24*b* provide protection for a significant portion of the side of the user's knee. In one embodiment, the left and right side portions 24*a*, 24*b* are formed integrally with the cover shell 24.

In one embodiment, the left and right side portions 24*a*, 24*b* extend outwardly from the front portion of cover shell 24. The left and right side portions 24*a*, 24*b* may extend from the front portion of cover shell 24 at an angle of about 75 degrees to about 105 degrees. In another embodiment, the left and right side portions 24*a*, 24*b* may extend from the front portion of cover shell 24 at an angle of about 85 degrees to about 100 degrees. In still another embodiment, the left and right side portions 24*a*, 24*b* may extend from the front portion of cover shell 24 at an angle of about 90 degrees.

In this aspect, the cushion pad 22 of the knee guard 6 may further include an inner knee pad. FIG. 3 shows a rear view of the leg guard in accordance with the present invention. As shown in FIG. 3, the inner knee pad 52 is situated on the rear side of the knee guard 6. In this aspect, the shape of the inner knee pad 52 shares the shape of the knee guard 6 such that the inner knee pad 52 may be situated within the cover shell 24 of the knee guard 6. The inner knee pad 52 may be detachably and adjustably fastened to the inside of cushion pad 22. Unlike conventional knee pads that are fixed in position, the inner knee pad of the present invention is repositionable within the knee guard 6 to provide increased comfort and mobility for the user. For instance, the inner knee pad 52 may be removably attached to cushion pad 22 with hook-and-loop closures, such as Velcro®, snaps, clips, or the like. The inner knee pad 52 may also include a knee hole 54. The knee hole 54 is designed to surround and support the knee cap portion of the knee, which provides additional stability to the joint when moving from the crouch stance to an upright position and vice versa.

The inner knee pad 52 and inner knee hole 54 may be made of any material that provides adequate support and shock absorbing properties. For example, the inner knee pad 52 may be made from open cell polyurethane, EVA foam, memory foam, gel impact pads, and a variety of other padding materials that protect the user's knee from impact. The inner knee pad 52 may also be made from a combination of any of the above-discussed padding materials. In another embodiment, the inner knee hole 54 may include Patella Plus™ d3o™ material as padding, which may be covered with a silicone gel.

The extended knee guard 8 includes a cushion pad 30 and a cover shell 32 that covers the cushion pad 30 and is affixed thereto. The thigh guard 10 also includes a cushion pad 34 and a cover shell 36 that covers the cushion pad 34 and is affixed thereto. Like cover shell 18 of the shin guard 4, cover shells 32 and 34 may include a plurality of air vents 20 that extend through the cover shells to allow for ventilation and expelling of sweat. The positioning and quantity of the air vents 20 are not limited.

Figure 4:
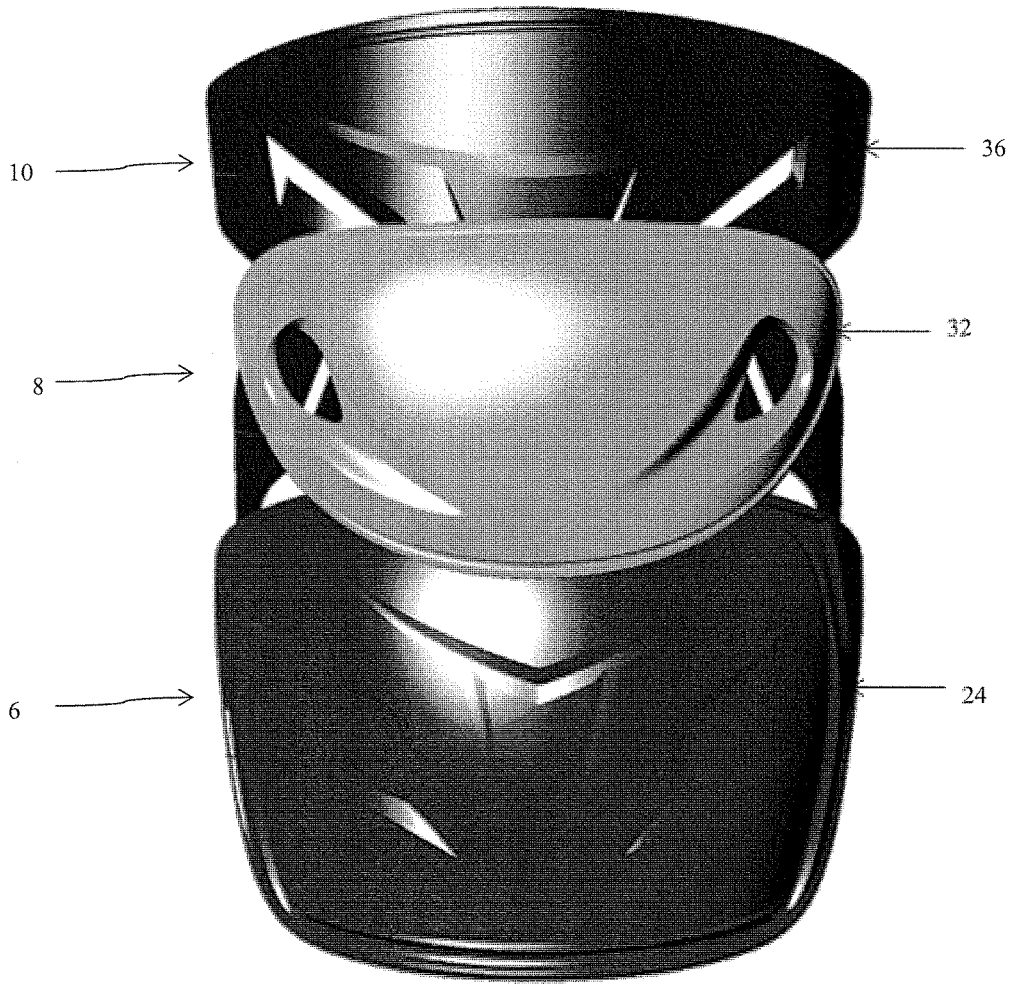
FIG. 4 shows a schematic front view of a portion of a leg guard according to the present invention.

FIG. 4 shows the configuration of the coupling of the knee guard 6, extended knee guard 8, and thigh guard 10. As shown in FIG. 4, the extended knee guard 8 overlays the knee guard 6 and the thigh guard 10 such that the extended knee guard 8 overlaps both the knee guard 6 and the thigh guard 10. The extended knee guard 8 may be attached to the knee guard 6, the thigh guard 10, or both the knee guard 6 and the thigh guard 10. In one embodiment, to ensure that the extended knee guard 8 remains in place, the extended knee guard 8 is attached to both the knee guard 6 and the thigh guard 10.

Figure 5A:
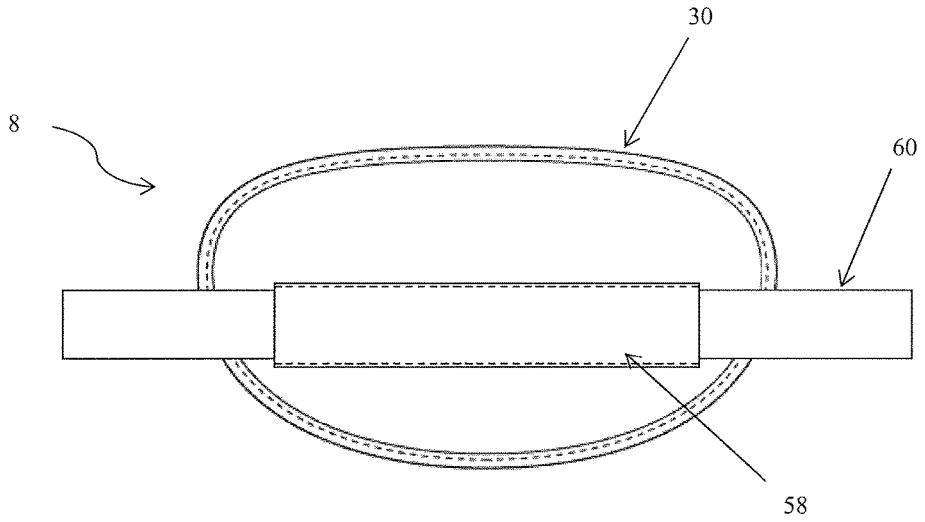
FIG. 5A shows a schematic rear view of a portion of a leg guard according to the present invention.
Figure 5B:
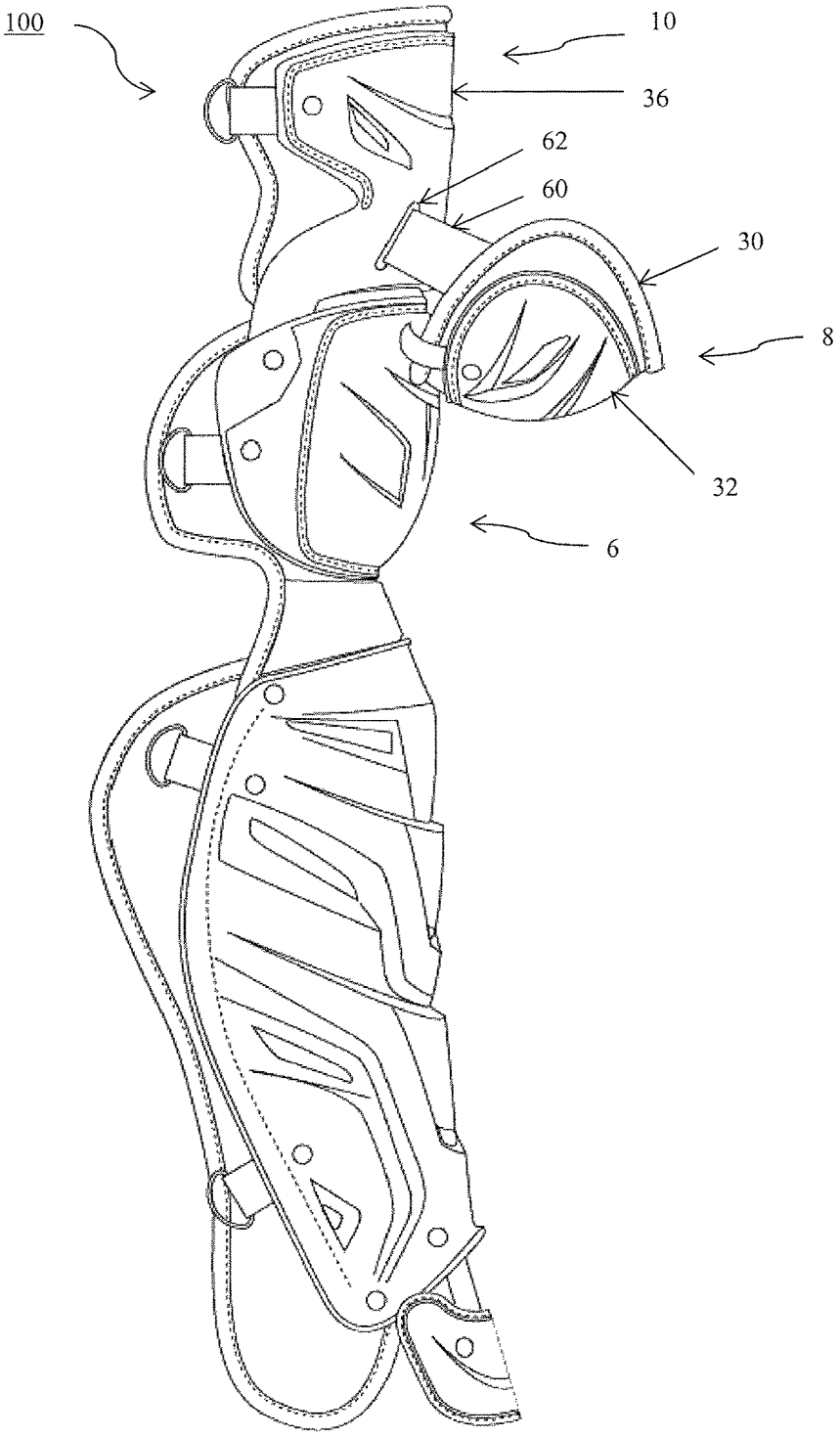
FIG. 5B shows a schematic side view of the leg guard according to one embodiment of the present invention.

The extended knee guard 8 may be attached to guards 6 and 10 using any suitable means known to those of ordinary skill in the art. In one embodiment, the extended knee guard 8 may be fastened to the thigh guard 10. FIG. 5A provides an example of a fastener contemplated by the present invention. As shown in FIG. 5A, the extended knee guard 8 may include a tube-like fastener 58 attached to the back side of guard 8, for example, attached to the back side of cushion pad 30, through which an elastic band 60 may be inserted. The ends of the elastic band 60 may operatively attach to a bottom portion of the thigh guard cover shell 36 such that the extended knee guard 8 is flexibly connected to the thigh guard 10 (as depicted in FIG. 5B). For instance, as shown in FIG. 5B, the ends of the elastic band 60 may be inserted through slots 62. The leg guard 100 may include at least two slots 62 located on a left and a right side of the cover shell 36. Each end of the elastic band 60 may be inserted through the slot 62 and secured to a bottom side of the cover shell 36. The dimensions and shape of slots 62 are not limited so long as the slots 62 secure the ends of the elastic band 60 and allow for the articulation of the extended knee guard 8. In one embodiment, the slots 62 may be rectangular in shape. In this aspect, the slots 62 may be about 0.1 inches to about 0.15 inches in width, for example, about 0.125 inches in width. The slots 62 may be about 1 inch to about 1.5 inches in height, for instance, about 1.25 inches in height. In addition, as shown in FIG. 5B, the slots 62 should be designed such that the slots 62 are angled to the center of the leg guard 100. In this aspect, the slots 62 may be angled to the center of the leg guard 100 at an angle of about 30 degrees to about 55 degrees. For instance, the slots 62 may be angled to the center of the leg guard 100 at an angle of about 33 degrees to about 45 degrees. The slots 62 allow for the elastic band 60 to be replaced in the field without the use of tools. In another embodiment, the elastic band 60 may be fastened by rivets or other fastening means that require the use of tools to replace.

The attachment of the elastic band 60 allows for the extended knee guard 8 to have a greater range of motion. As demonstrated in FIG. 5B, the extended knee guard 8 is capable of articulating greater than 90 degrees. This enhanced flexibility and articulation allows for the extended knee guard 8 to cover the gap between the thigh guard 10 and the knee guard 6 when the user moves to/through a plurality of positions and prevent an object, such as a baseball or softball, from passing through.

Figure 5C:
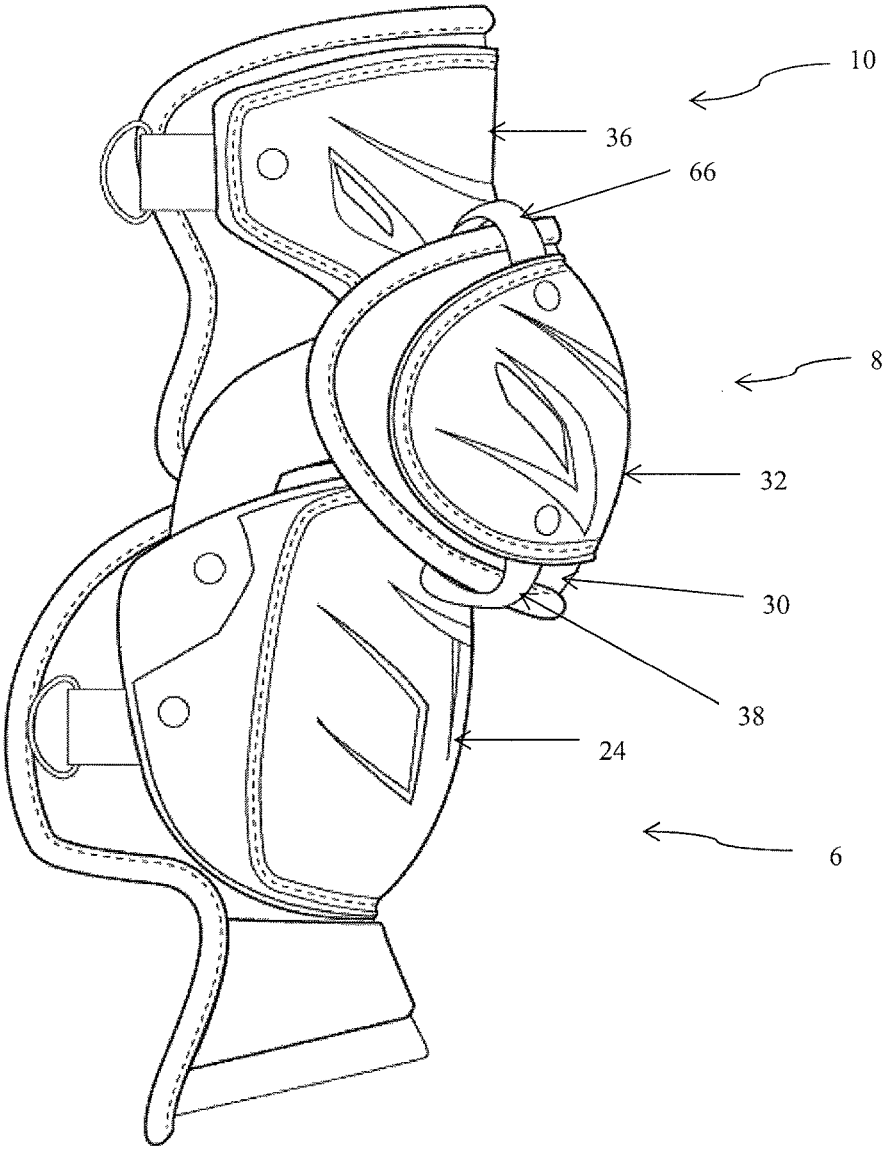
FIG. 5C shows a schematic side view of a portion of the leg guard according to another embodiment of the present invention.

In another embodiment, the extended knee guard 8 may be attached to knee guard 6 via one or more straps. For instance, as shown in FIG. 1, two straps 38 are formed such that one end of each strap 38 is secured by one or more rivets to the knee guard cover shell 24. The other end of each strap 38 is sandwiched between a lower portion of the cover shell 32 and cushion pad 30 of the extended knee guard 8 and are secured by one or more rivets. The extended knee guard 8 may also be fastened to the thigh guard 10 in a similar manner. For instance, two or more straps may be formed such that one end of each strap is secured to the thigh guard cover shell 36. The other end of each strap may be secured between an upper portion of the cover shell 32 and cushion pad 30 of the extended knee guard 8. In this aspect, the straps may be used alone or in combination with the tube-like fastener 58 to secure the extended knee guard 8 to the thigh guard 10. In one embodiment, the straps may be used without the tube-like fastener 58. For example, the extended knee guard 8 may be attached to both the knee guard 6 and the thigh guard 10 via one or more straps. As shown in FIG. 5C, the extended knee guard 8 is attached to the knee guard 6 via straps 38. One end of each strap 38 is secured by to the knee guard cover shell 24 and the other end of each strap 38 is sandwiched between a lower portion of the cover shell 32 and cushion pad 30 of the extended knee guard 8. The extended knee guard 8 is also attached to the thigh guard 10 via straps 66. One end of each strap 66 is secured to the thigh guard cover shell 36 and the other end of each strap may be secured between an upper portion of the cover shell 32 and cushion pad 30 of the extended knee guard 8. Straps 38 and 66 may be positioned on both the left and right sides of the extended knee guard 8.

Figure 6A:
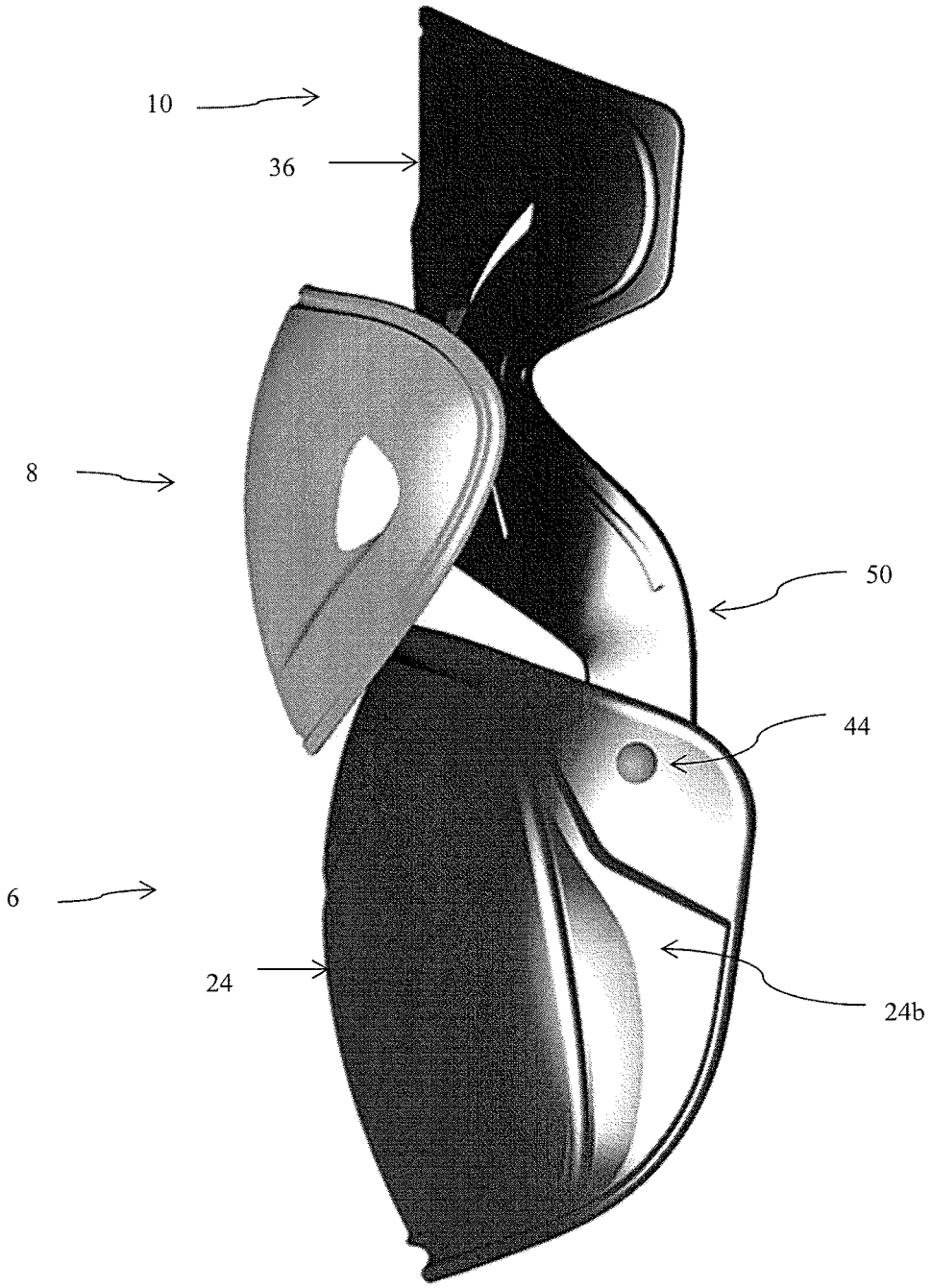
FIG. 6A shows a schematic side view of a portion of a leg guard according to the present invention.

FIG. 6A shows a side view of the configuration of the coupling of the knee guard 6, extended knee guard 8, and thigh guard 10 in a standing position. As can be seen in FIG. 6A, the knee guard 6 is connected to the thigh guard 10. In one embodiment, the cover shell 24 of knee guard 6 is connected to the cover shell 36 of thigh guard 10 via a hinge 50. In this aspect, the hinge 50 operatively attaches the thigh guard 10 to the knee guard 6. The present invention contemplates the use of hinge 50 on both the left and right sides of the leg guard 100.

Figure 6B:
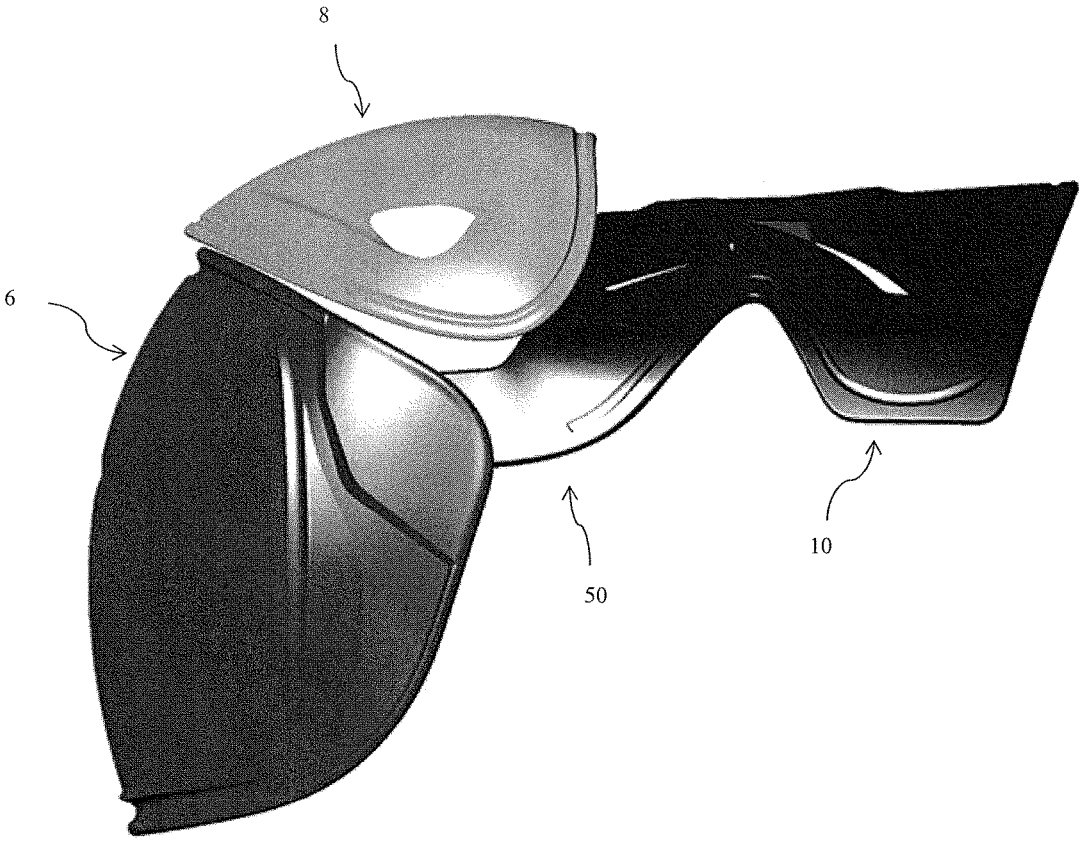
FIG. 6B shows another schematic side view of a portion of a leg guard according to the present invention.

The hinge 50 allows the knee guard 6/extended knee guard 8/thigh guard 10 configuration to bend or pivot such that each of the guards 6, 8, and 10 remains in place when the user assumes any one of a plurality of positions from squatting or crouching to/through an intermediate position to/through an upright position. The hinge 50 also prevents the thigh guard 10 from sliding up and down the thigh when the user changes position. FIGS. 6A and 6B show the leg guard 100 in varying degrees of movement and demonstrate the range of motion of the hinge 50 of the leg guard 100 from a standing upright position to a crouching position. As shown in FIGS. 6A and 6B, the hinge 50 allows for the smooth bending of the knee guard 6/extended knee guard 8/thigh guard 10 configuration from a standing upright position to a crouching position without misalignment or mispositioning of the thigh guard 10. More particularly, as demonstrated by FIG. 6B, the hinge 50 allows for the thigh guard 10 to bend at an angle of less than 90 degrees in relation to the knee guard 6, for example, at an angle of about 45 degrees, when the user is in the crouching position so as to prevent the leg guard 100 from moving or rotating about the user's leg.

In this aspect, the hinged configuration of the present invention allows the leg guard 100 to remain static without axial rotation or vertical movement. That is, the hinged configuration of the present invention allows the leg guard 100 to remain in its original position, which is defined as the vertical position from the center of the kneecap to the ankle, without axial rotation or vertical movement. In one embodiment, when the user moves to/through a plurality of positions, the hinge 50 provides for a change in vertical positioning of the leg guard 100 about the user's leg from its original position of less than 10 percent. In another embodiment, the hinge 50 provides for a change in vertical positioning of the leg guard 100 about the user's leg from its original position of less than 8 percent. In still another embodiment, the hinge 50 provides for a change in vertical positioning of the leg guard 100 about the user's leg from its original position of less than 5 percent. Similarly, during the user's movement, the hinged configuration of the present invention provides for an axial rotation of the leg guard 100 about the user's leg from its original position of at most 10 degrees. For example, the hinged configuration of the present invention provides for an axial rotation of the leg guard 100 about the user's leg from its original position of at most 8 degrees. In yet another embodiment, the hinged configuration of the present invention provides for an axial rotation of the leg guard 100 about the user's leg from its original position of at most 5 degrees.

Figure 7A:
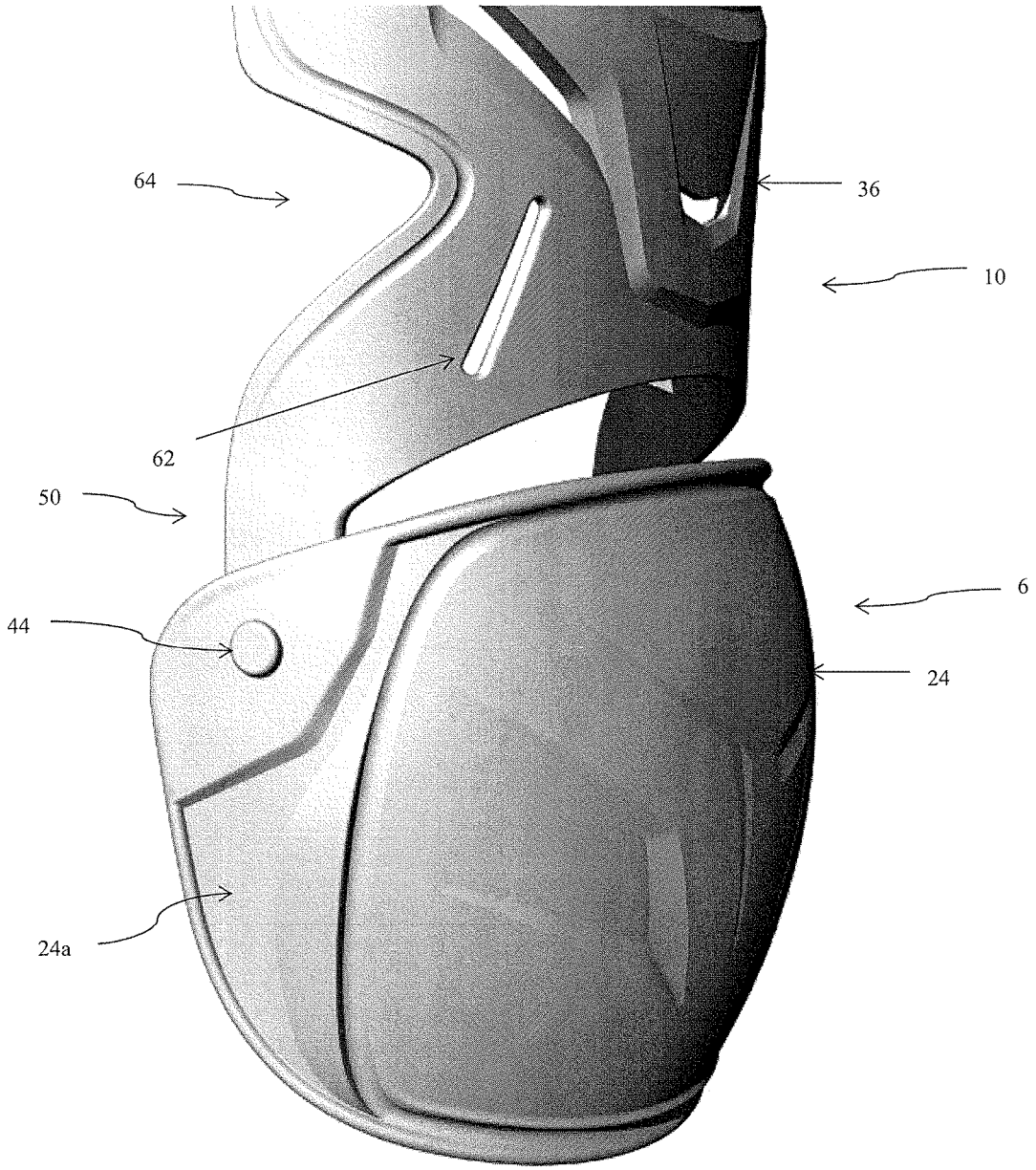
FIG. 7A shows a schematic side view of a portion of a leg guard in accordance with the present invention.
Figure 7B:
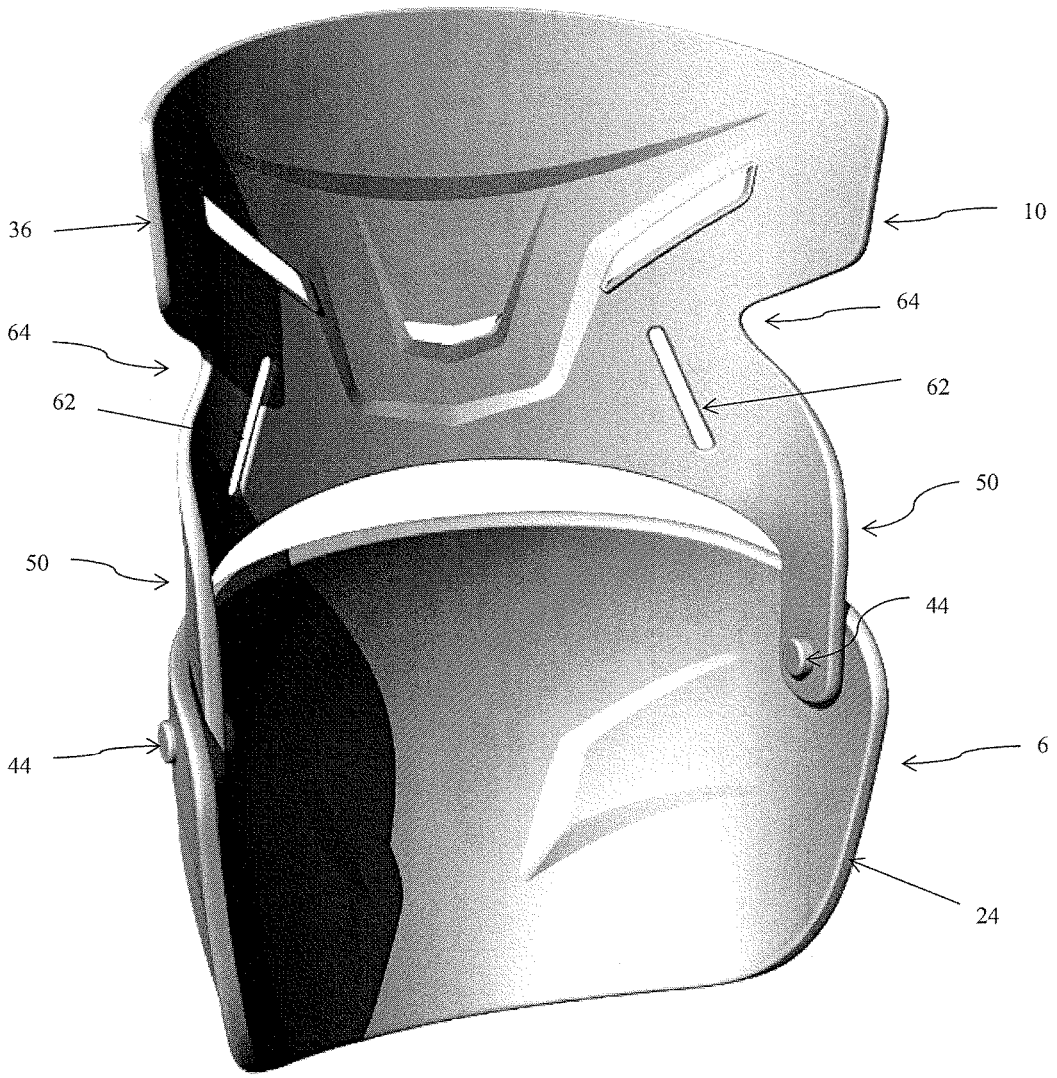
FIG. 7B shows a schematic rear view of the portion of the leg guard according to FIG. 7A.

In one embodiment, the hinge 50 may be formed integrally with the cover shell 24 of the knee guard 6 or the cover shell 36 of the thigh guard 10. FIGS. 7A and 7B provide front and rear views, respectively, of an integrally formed hinge 50. As shown in FIGS. 7A and 7B, the hinge 50 may be formed integrally with the cover shell 36 of thigh guard 10. In another embodiment, the hinge 50 may be a separate piece of material that connects the cover shell 36 to the cover shell 24. In this aspect, the hinge 50 is adapted to engage both the knee guard 6 and thigh guard 10. The hinge 50 may be removably attached to both the cover shell 36 and cover shell 24 to allow for the hinge 50 to be replaced if the function of the hinge 50 is inhibited in any way.

When the hinge 50 is attached to the thigh guard 10, the cover shell 36 of the thigh guard 10 may have any desired shape so long as the cover shell 36 allows for the hinge to function. In one embodiment, the cover shell 36 may have a symmetrical butterfly shape. That is, each side of the cover shell 36 may have a middle portion that is cut out. For instance, as shown in FIGS. 7A and 7B, each left and right edge of the cover shell 36 may include a notch 64 in the middle portion of the cover shell 36. The notch 64 may be an angular, V-shaped, U-shaped, or rectangular indentation in the edge of the cover shell 36. The innermost point of the notch 64 may be about 1 inch to about 2.5 inches from the edge of the cover shell 36. For example, the distance from the innermost point of the notch 64 to the edge of the cover shell 36 may be about 1.5 inches to about 2 inches. The height of the notch 64 may be about 0.5 inches to about 2 inches. In another embodiment, the notch 64 may be about 0.75 inches to about 1.5 inches in height. In this aspect, the use of the notch 64 allows the cover shell 36 of thigh guard 10 to flex independent of the hinge 50. This prevents the leg guard 100 from changing position when the user moves through a plurality of positions. In addition, the use of the notch 64 allows the thigh guard 10 to conform to varying shapes and curvatures of users' thighs.

In another embodiment, each side of the cover shell 36 may not include any notches. In other words, each side of the cover shell 36 may include continuous material that extends straight down to the hinge 50. In still another embodiment, the cover shell 36 may have an asymmetrical shape. For instance, one edge of the cover shell 36 may include a notch 64, while the opposite edge of the cover shell 36 may include continuous material that extends straight down to the hinge 50. In this aspect, the edge of the cover shell 36 having the notch should be the edge on the outer portion of the cover shell 36. However, regardless of the shape of the cover shell 36, the cover shell 36 should generally be flat so that the thigh guard 10 rests along the top side of the user's thigh. In another embodiment, the cover shell 36 may have a slight curvature to allow for a more comfortable fit along the user's thigh. For example, the cover shell 36 may be designed such that the top portion of the cover shell 36 is substantially flat and the side portions of the cover shell 36 gradually curve to match the contour of the user's thigh. In one embodiment, the middle radius of the curvature of cover shell 36 may be about 5 inches to about 6 inches, for example, about 5.5 inches. The edge radius of the curvature of cover shell 36 may be about 1 inch to about 2 inches, for example, about 1.5 inches.

Regardless of whether the hinge 50 is a separate piece of material or integrally formed with the cover shell, the hinge 50 should include at least one curvature to allow for the knee guard 6/extended knee guard 8/thigh guard 10 configuration to bend or pivot. The hinge 50 may be positioned between the knee guard 6 and the thigh guard 10 so as to allow for a smooth pivot between a standing position and a crouching position and vice versa. For example, the hinge 50 should be positioned on the leg guard 100 such that the hinge 50 is parallel to the upper knee area of the user, for example, parallel to the top tendon of the user's knee. In this embodiment, the hinge 50 may be about 2 inches to about 4.5 inches in height. In another embodiment, the hinge 50 may be about 2.5 inches to about 4 inches in height. For example, the hinge 50 may be about 3 inches to about 3.75 inches in height. In another embodiment, the hinge 50 may be about 0.5 inches to about 2.5 inches in width. In yet another embodiment, the hinge 50 may be about 1 inch to about 2 inches in width.

Figure 8:
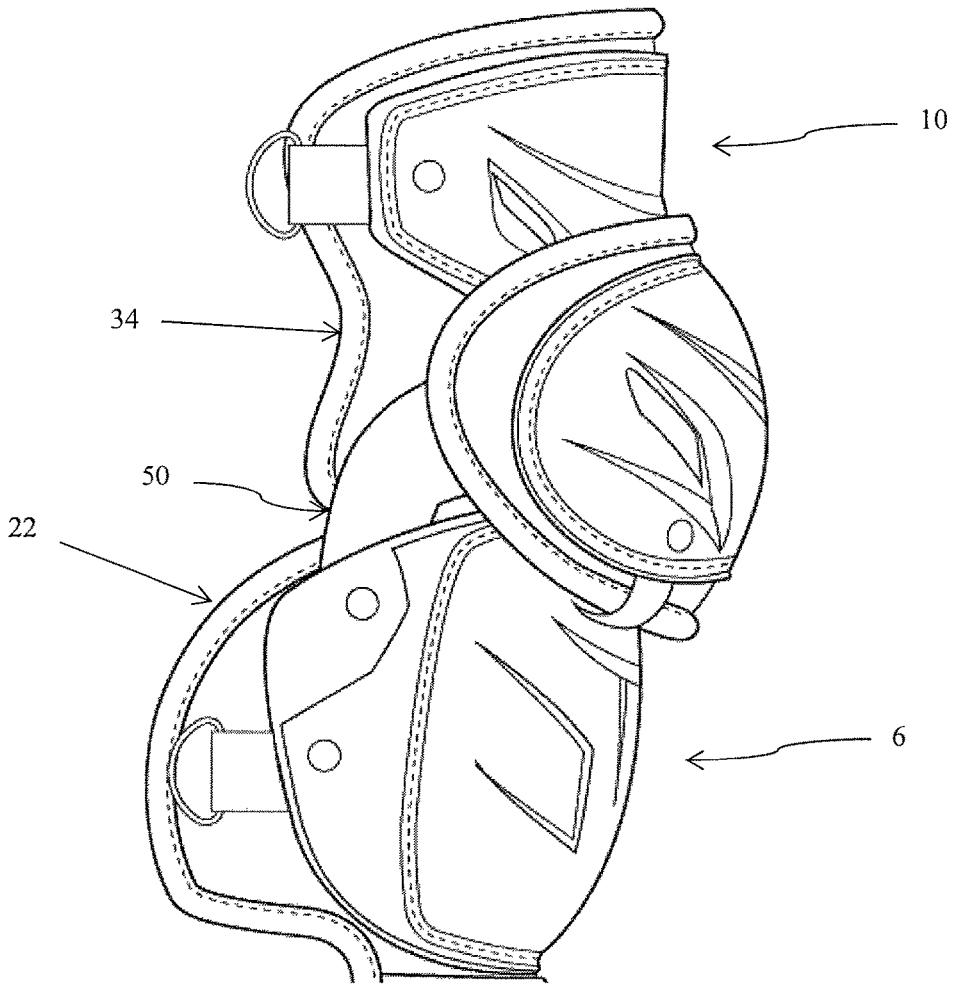
FIG. 8 shows a side view of a portion of a leg guard according to FIG. 2.

In one embodiment, the hinge 50 may rest on the cushion pad 34 of the thigh guard 10 and the cushion pad 22 of the knee guard 6. That is, cushion pad 34 and cushion pad 22 are designed to meet and cushion the hinge 50 such that the hinge 50 does not contact the user's body. For instance, FIG. 8 shows an upper side view of the leg guard 100. As shown in FIG. 8, cushion pad 34 of thigh guard 10 extends downward to meet cushion pad 22 of knee guard 6. The hinge 50 rests on the top surface of both cushion pads 22 and 34. In another embodiment, the hinge 50 may be enclosed within cushioning or padding. For example, the hinge 50 may be enclosed within a sleeve of padding. In this aspect, the sleeve may be made from any of the materials disclosed herein suitable for cushion pads 12, 16, 22, 30, and 34. In another embodiment, the sleeve may be made of rubber.

Figure 9A:
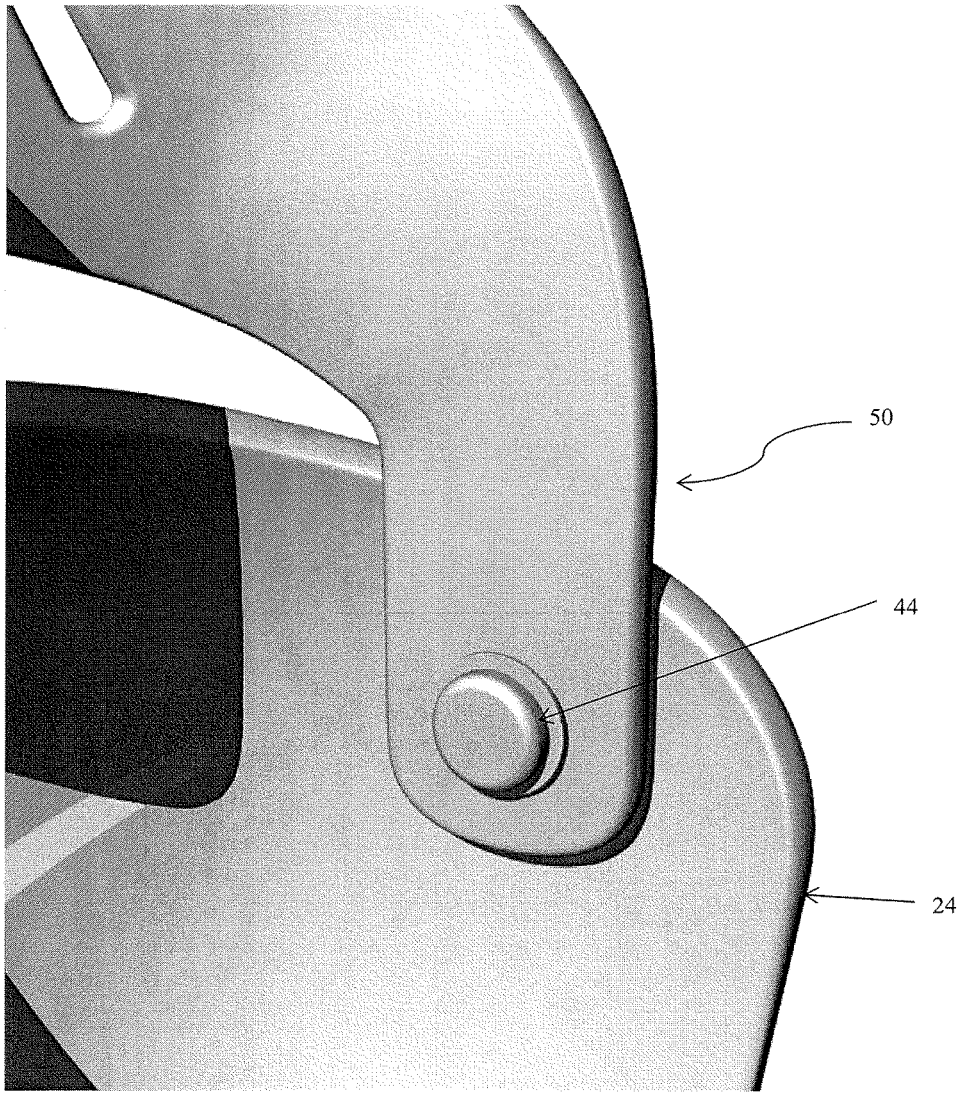
FIG. 9A shows a portion of a leg guard according to the present invention.

In one embodiment, when the hinge 50 is integrally formed with the cover shell of the knee guard 6 or the cover shell of the thigh guard 10, the hinge 50 is attached to the opposing cover shell at a single pivot point. For example, as shown in FIGS. 6A and 7A, the integrally formed hinge 50 is connected to the cover shell 24 of the knee guard 6 at a pivot point 44. In one embodiment, as depicted in FIG. 7B, the cover shell 24 includes a pivot point 44 on both the left and right sides of knee guard 6. The pivot point 44 should be placed on an upper edge of a side portion of the cover shell 24, for example, left and right side portions 24*a*, 24*b*, so that the hinge 50 does not interfere with the function of the knee guard 6. For instance, pivot point 44 should be placed about 0.35 inches to about 0.65 inches from the upper edge of cover shell 24. In another embodiment, the pivot point 44 may be placed about 0.45 inches to about 0.55 inches from the upper edge of cover shell 24. In still another embodiment, the pivot point 44 may be placed about 0.5 inches from the upper edge of cover shell 24. In another embodiment, pivot point 44 should be placed about 0.9 inches to about 1.25 inches from the outer side edge of the cover shell 24. In yet another embodiment, the pivot point 44 should be placed about 1 inch to about 1.15 inches from the outer side edge of the cover shell 24. For example, the pivot point 44 may be placed about 1.125 inches from the outer side edge of the cover shell 24. FIG. 9A shows an inside view of the hinge 50 attached to the cover shell 24 of the knee guard 6 at pivot point 44. As shown in FIG. 9A, pivot point 44 is positioned at an upper edge of a side portion of cover shell 24. Indeed, the placement of pivot point 44 as contemplated by the present invention allows for the thigh guard 10 to remain flat against the user's thigh and prevents the thigh guard 10 from sliding up and down the user's thigh. While the location of pivot point 44 is described herein according to one embodiment of the present invention, the location of pivot point 44 may vary based on the different designs of leg guard 100 contemplated by the present invention. For example, the location of pivot point 44 may vary depending on the use of and the thickness of inner knee pad 52.

Figure 9B:
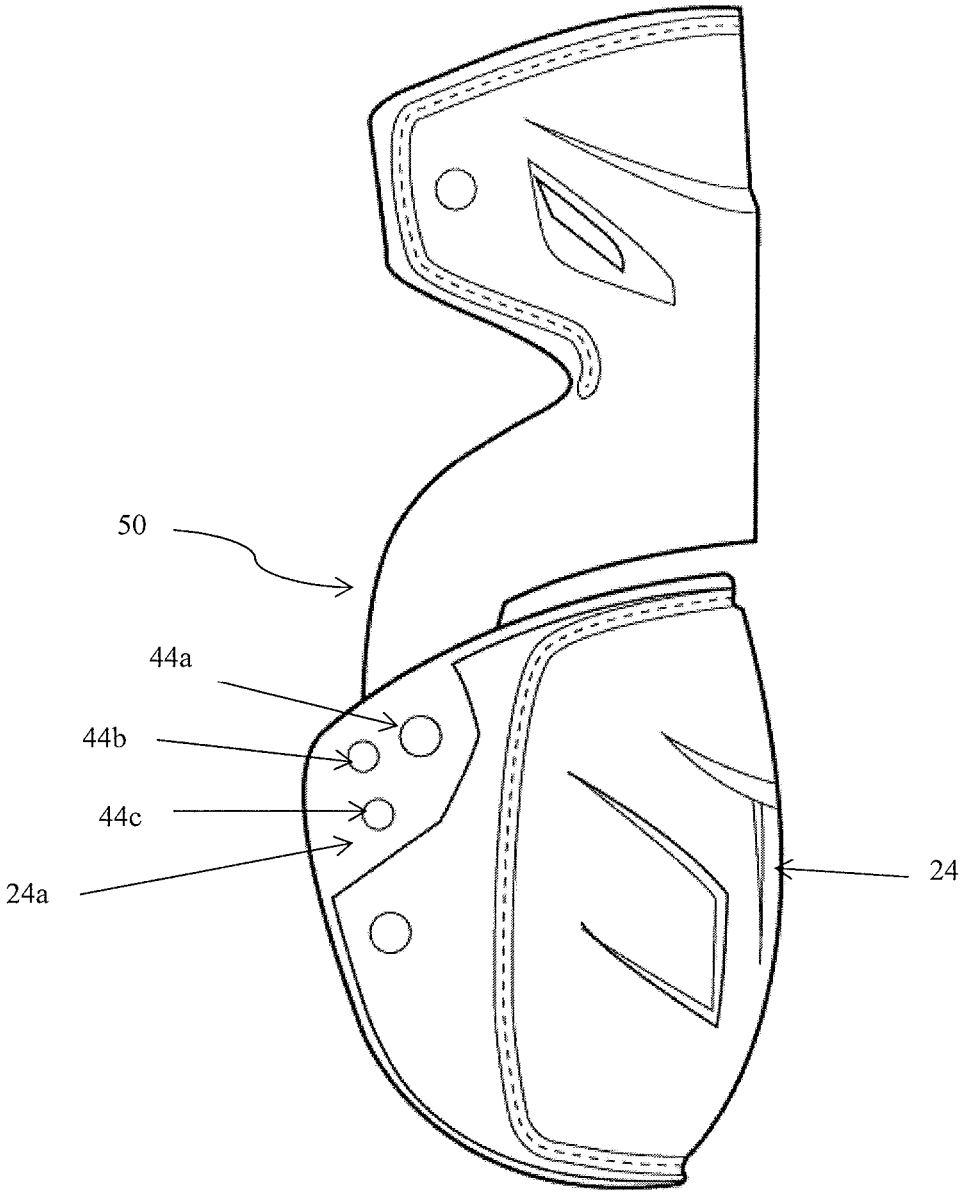
FIG. 9B shows a portion of a leg guard according to another embodiment of the present invention.
Figure 9C:
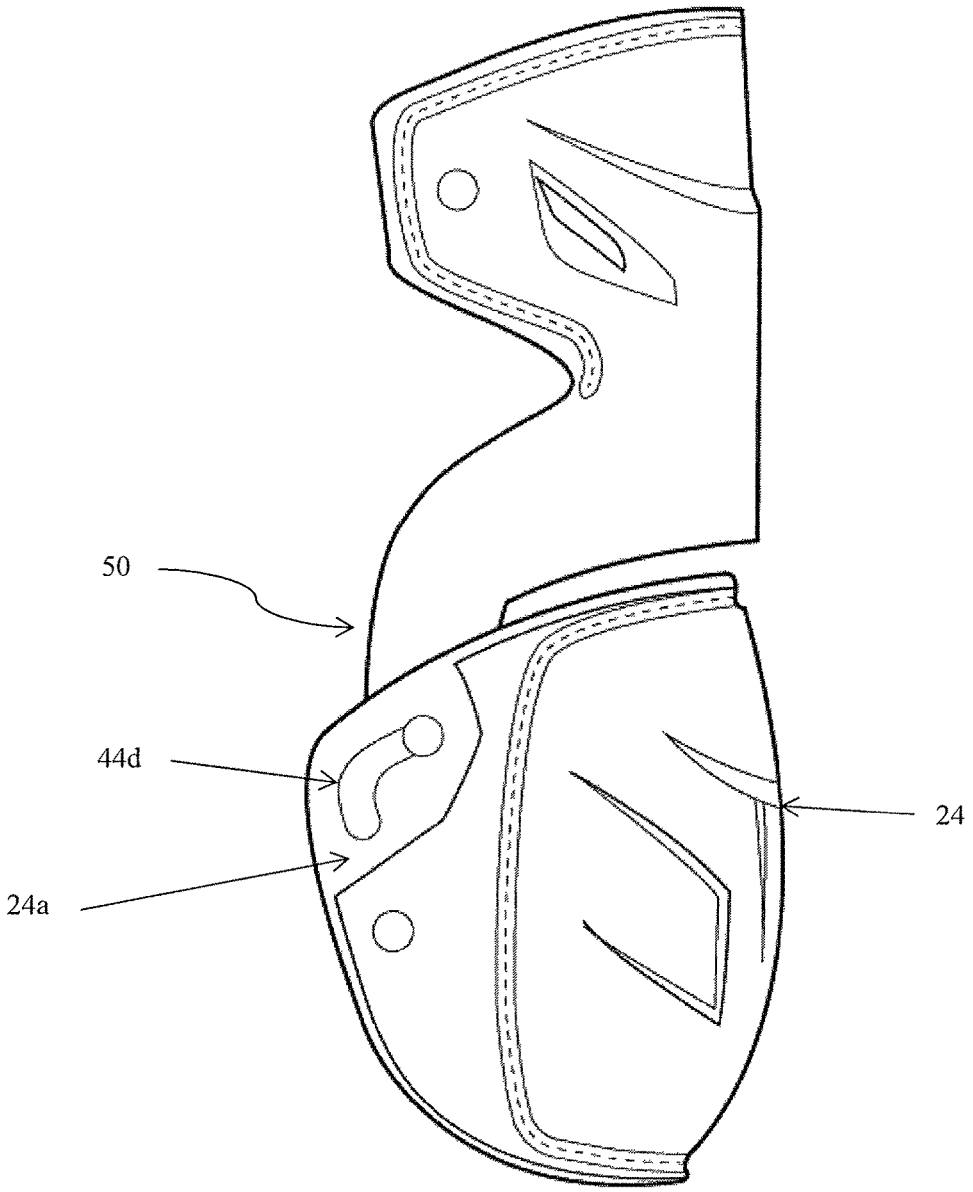
FIG. 9C shows a portion of a leg guard according to yet another embodiment of the present invention.

In another embodiment, the pivot point 44 of the hinge 50 may be repositionable on cover shell 24 to adjust to the size of the user's leg. For example, the cover shell 24 may include a plurality of slots configured to receive the pivot point 44 of the hinge 50. This configuration allows for the pivot point 44 to be adjusted among a plurality of slots on cover shell 24. The plurality of slots for the adjustable pivot point 44 may be positioned at any points on the extended left and right side portions 24*a*, 24*b* of cover shell 24 so long as the location of the pivot point 44 is within the parameters discussed above. In addition, the number and shape of the slots are not limited so long as the slots do not interfere with the function of the pivot point 44 of the hinge 50. FIG. 9B shows one embodiment of a plurality of slots for an adjustable pivot point 44. As shown in FIG. 9B, the pivot point 44 may be adjusted among three circular slots 44*a*, 44*b*, 44*c*. The three slots 44*a*, 44*b*, 44*c* are positioned at different locations on the side portion 24*a* such that pivot point 44 may be adjusted among slots 44*a*, 44*b*, 44*c* depending on the size of the user's leg. In this aspect, slots 44*a*, 44*b*, 44*c* may have the same diameter. In another embodiment, the cover shell 24 may include an elongated slot configured to adjustably receive the pivot point 44 of the hinge 50. In this aspect, the pivot point 44 may include locking hardware that allows for the pivot point 44 to slide along the elongated slot and lock into place at the desired location. The length, width, and shape of the elongated slot are not limited so long as the elongated slot is configured to receive and secure the pivot point 44. For instance, FIG. 9C shows an elongated slot 44*d* contemplated by the present invention. As shown in FIG. 9C, the elongated slot 44*d* may extend across side portion 24*a* and curve downward such that the pivot point 44 may be adjustable in both the horizontal and vertical directions. The pivot point 44 may slide along the elongated slot 44*d* and lock into place at the desired location.

In this aspect, the hinge 50 may be attached to an inside portion or an outside portion of the cover shell 24 of the knee guard 6 and/or the cover shell 36 of the thigh guard 10. In one embodiment, the hinge 50 is attached to an inside portion of the cover shell 24 of the knee guard 6 and/or the cover shell 36 of the thigh guard 10. In this aspect, as shown in FIG. 9, the hinge 50 should be attached to the cover shell 24 of the knee guard 6 and/or the cover shell 36 of the thigh guard 10 at a perpendicular angle, for example, at an angle of about 90 degrees. The hinge 50 may be attached to the cover shells at the pivot points by any suitable means for securing the hinge 50 to the cover shell 24 of the knee guard 6 and/or the cover shell 36 of the thigh guard 10. For instance, the hinge 50 may be secured to the cover shells by rivets, rubber bushings, pins, t-nuts, screws, binding barrels, bearings, or press fits.

The hinge 50 may be formed from any material capable of allowing the hinge 50 to function properly, for example, allowing for the smooth bending of the knee guard 6/extended knee guard 8/thigh guard 10 configuration to/through a plurality of positions. In one embodiment, when the hinge 50 is integrally formed with the cover shell 24 of the knee guard 6 or the cover shell 36 of the thigh guard 10, the hinge may be formed from the cover shell material. However, when the hinge 50 is formed as a separate piece of material, the hinge 50 may be formed from materials including, but not limited to, elastomers, cast or injected metal, rubber, carbon fiber, or glass composite.

The leg guard 100 is removably and adjustably attachable to the leg of a user. In one embodiment, the leg guard 100 includes a strapping system that is provided to secure the leg guard 100 in position. The strapping system of the present invention includes at least a thigh strap and a shin strap. Due to the design of the leg guard 100, the use of a knee strap is not necessary. Indeed, the configuration of the coupling of the knee guard 6, the extended knee guard 8, and the thigh guard 10 dispenses of the need for a knee strap. Nonetheless, in other embodiments, more straps, including a knee strap, may be included in the strapping system of the present invention for extra security and support.

The leg guard 100 includes a plurality of metal or plastic loops 42 to which any of the above mentioned straps may be fastened. As will be apparent to one of ordinary skill in the art, the loops 42 may be positioned at any location on the leg guard 100 that is deemed suitable for fastening a strap and the loops 42 may be used in any quantity deemed necessary. According to one embodiment, loops 42 are positioned on left and right sides of the shin guard 4, knee guard 6, and thigh guard 10. The loops 42 are connected to webs of nylon or similar strap material that are sandwiched between each of the cover shells and cushion pads 18, 16; 24, 22; and 36, 34 and are connected thereto by one or more rivets. Each loop 42 may be composed of a single metal or plastic loop or two metal or plastic loops. Any of the straps contemplated by the present invention may carry hook fasteners for connecting to loops 42 to securely and adjustably connect the leg guard 100 to the leg of the user.

Figure 10:
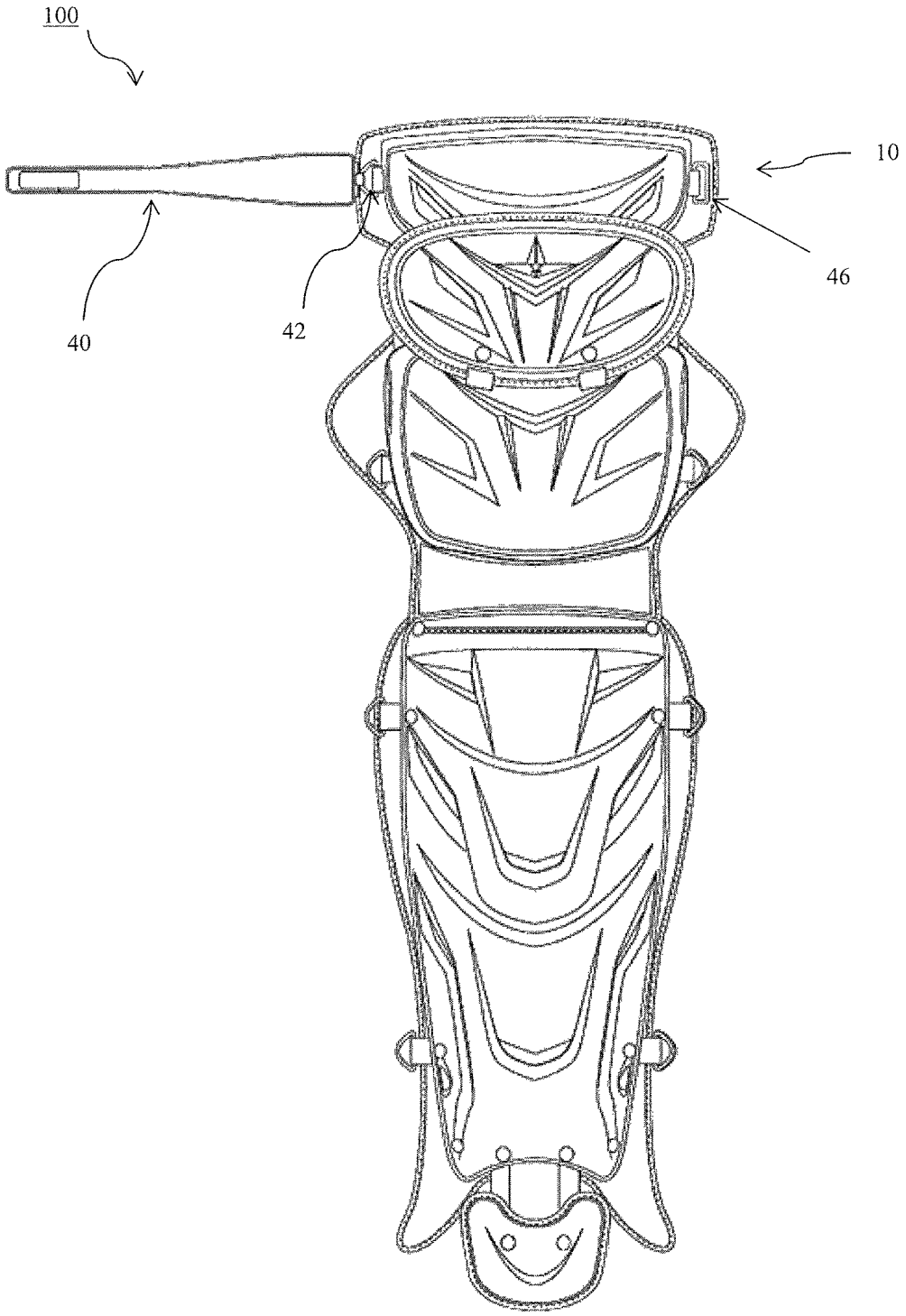
FIG. 10 shows a schematic front view of a leg guard of the present invention according to another embodiment.

In one embodiment, the leg guard of the present invention includes a thigh strap. The thigh strap is designed to secure the thigh guard 10 to the thigh of the user. As discussed above, because the thigh guard 10 does not move up and down the thigh, the present invention allows for a thigh strap that is thicker and more comfortable than conventional thigh straps. FIG. 10 shows a leg guard 100 according to the present invention with a thigh strap removably attached to thigh guard 10. As shown in FIG. 10, the thigh strap 40 includes a hook fastener that removably fastens the thigh strap 40 to the thigh guard 10 via loop 42. In this aspect, the leg guard may further include a loop similar to loop 42, but rectangular in shape, for receiving the thigh strap 40. For instance, as shown in FIG. 10, the thigh guard 10 may include a rectangular loop 46 through which the thigh strap 40 may be pulled and then secured in position.

The thigh strap 40 may include an adjustable portion, for example, an extra length of material, that may be pulled through a slot or loop fastened to the leg guard and secured in position to lengthen or shorten the strap. In this aspect, thigh strap 40 may include one or more hook-and-loop closures, such as Velcro®0, snaps, clips, or the like, to secure the strap. In one embodiment, as shown in FIG. 10, thigh strap 40 has a tapered design in which the wider portion of the strap is secured around the thigh of a user. The wider portion of the strap creates less irritation for the hamstring of the user. In this aspect, at the widest point on the strap, the thigh strap 40 may be about 1.25 inches to about 2 inches wide. In another embodiment, the thigh strap 40 may be about 1.5 inches to about 1.75 inches wide.

The leg guard of the present invention also includes at least one shin strap. The shin strap is designed to secure the shin guard 4 to the shin portion of the user's leg. In one embodiment, the leg guard of the present invention includes an upper and lower shin strap. In another embodiment, the leg guard of the present invention includes a lower leg harness. The lower leg harness is designed to secure the knee guard 6 and shin guard 4 to the leg of a user. In this aspect, the lower leg harness may include a center harness material that is designed to cradle the back of the calf muscle of the user and one or more straps attached to the center harness material that are configured to fasten to one or more loops 42. The center harness material may be formed of neoprene. In one embodiment, the lower leg harness may be a Delta Flex™ leg harness.

Any of the above-mentioned straps are made of a durable, resilient material. For instance, the straps of the present invention may be made of a woven natural or synthetic material, such as woven nylon. In another embodiment, the straps of the present invention may be made of elastic or neoprene.

While the straps of the present invention have been presented herein as removably attachable to a side of the leg guard, the present invention also contemplates straps that are fixedly attached to one side of the leg guard, for example, by sewing, stitching, or riveting the straps to the corresponding cushion pads or cover shells. In this aspect, on the other side of the leg guard, the straps may be detachably attachable to the leg guard. For instance, a securing mechanism, such as a hook or clip, is provided on the strap. The securing mechanism removably attaches to a corresponding slot, clip, or hook fixedly attached to the leg guard.

As discussed above, the cover shells 14, 18, 24, 32, and 36 are affixed to cushion pads 12, 16, 22, 30, and 34, respectively. This configuration provides the most comfortable protection against impacts and collisions, as the outer cover shell provides resistance to hard collisions while dissipating the impact force through the cushion pads. The cushion pads 12, 16, 22, 30, and 34 may be fixedly or removably attached to the cover shells 14, 18, 24, 32, and 36. In one embodiment, the cushion pads 12, 16, 22, 30, and 34 are fixedly attached to the cover shells 14, 18, 24, 32, and 36. The cushion pads 12, 16, 22, 30, and 34 may be fixedly attached to the cover shells 14, 18, 24, 32, and 36 by any method known in the art, such as with an adhesive, rivets, fasteners, stitches, or the like. In one embodiment, the cushion pads 12, 16, 22, 30, and 34 may be fixedly attached to the cover shells 14, 18, 24, 32, and 36 by a combination of rivets and stitching. In another embodiment, the cushion pads 12, 16, 22, 30, and 34 may be fixedly attached to the cover shells 14, 18, 24, 32, and 36 by continuous stitching generally around the perimeter of the cover shells. In yet another embodiment, the cushion pads 12, 16, 22, 30, and 34 may be fixedly attached to the cover shells 14, 18, 24, 32, and 36 by discontinuous stitching generally around the perimeter of the cover shells. For example, the cushion pads 12, 22, 30, and 34 may be attached to the cover shells 14, 24, 32, and 36 by continuous stitching generally around the perimeter of the cover shells and cushion pad 16 may be attached to cover shell 18 through discontinuous stitching around various perimeter areas of cover shell 18. In addition, with respect to the knee guard 6, the cover shell 24 may be attached to cushion pad 22 with stitching around the front (kneecap) area of the cover shell 24 such that the side areas of the cover shell 24 corresponding to the left and right sides of the user's knee are not stitched or attached to the side areas of the cushion pad 22.

The cushion pads 12, 16, 22, 30, and 34 may be made of any material that allows for support and protection of the user's leg. In one embodiment, the cushion pads 12, 16, 22, 30, and 34 are formed of expanded polyurethane, cross-linked polyethylene, soft rubber foam, memory foam, gel padding, or compression molded foams such as EVA. The cushion pads 12, 16, 22, 30, and 34 may be encased in a thin, resilient covering of plastic material and the peripheral edges are covered by a plastic sewn-in-place binding. In another embodiment, the cushion pads 12, 16, 22, 30, and 34 may be coated with a microorganism-resisting and mildew-retarding treatment agent. The cushion pads 12, 16, 22, 30, and 34 may also include a plurality of air vents. In one embodiment, the air vents on cushion pads 12, 16, 22, 30, and 34 may be in air communication with the plurality of air vents 20 on cover shell 18 for exhaust of air upon impact.

Similarly, the cover shells 14, 18, 24, 32, and 36 may be made of any material that allows for protection against impacts and collisions, for example, from a speeding ball. In one embodiment, the cover shells 14, 18, 24, 32, and 36 are made of a rigid plastic or composite material, such as high density polyethylene, fiberglass, or carbon reinforced epoxy. In another embodiment, the cover shells 14, 18, 24, 32, and 36 may be co-molded with a cushion pad such that the co-molded material is a combination of rigid and soft material. For example, the cover shells 14, 18, 24, 32, and 36 may be formed from two-shot injection molded materials. In this aspect, the selected material should be moldable such that the cover shells 14, 18, 24, 32, and 36 may be curved to best match the curvature of the leg. Moldable materials also allow the user to squeeze and bend the cover shells to suitably wrap around their legs.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A leg guard, comprising:

a toe guard having a first cover shell and a first cushion pad affixed to a bottom side of the first cover shell, a shin guard having a second cover shell and a second cushion pad affixed to a bottom side of the second cover shell, wherein the shin guard is attached to and positioned in vertical alignment with the toe guard, a knee guard having a third cover shell and a third cushion pad affixed to a bottom side of the third cover shell, wherein the knee guard is attached to and positioned in vertical alignment with the shin guard, a thigh guard having a fourth cover shell and a fourth cushion pad affixed to a bottom side of the fourth cover shell, a left hinge and a right hinge, wherein the left and right hinges operatively connect the thigh guard to the knee guard, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, wherein the extended knee guard is attached to the thigh guard by at least two top straps, wherein one end of each top strap is secured to the fourth cover shell and the other end of each top strap is secured between an upper portion of the fifth cover shell and the fifth cushion pad, and a strapping system configured to removably and adjustably attach the leg guard.

2. The leg guard of claim 1, wherein the left and right hinges each comprise a first end and a second end, and each of the first ends is formed integrally with the fourth cover shell and each of the second ends is removably attached to the third cover shell.

3. The leg guard of claim 1, wherein the left and right hinges each comprise a first end and a second end, and each of the first ends is removably attached to the fourth cover shell and each of the second ends is removably attached to the third cover shell.

4. The leg guard of claim 1, wherein the fourth cover shell comprises a left edge and a right edge, the left and right edges each comprising a symmetrical indentation.

5. The leg guard of claim 4, wherein the symmetrical indentation is angular, V-shaped, U-shaped, or rectangular.

6. The leg guard of claim 1, wherein the fourth cover shell comprises a left edge and a right edge, and one of the left or right edges comprises an angular, V-shaped, U-shaped, or rectangular indentation.

7. The leg guard of claim 1, wherein the thigh guard is configured to articulate less than 90 degrees relative to the knee guard upon movement of the user to a crouching position, and wherein the thigh guard is configured to articulate without a change in axial rotation or vertical displacement about a user's leg.

8. The leg guard of claim 1, wherein the fifth cushion pad comprises a tube-like fastener affixed to a bottom portion of the fifth cushion pad, wherein the tube-like fastener is configured to receive an elastic band, the elastic band comprising two ends, and wherein each of the ends of the elastic band are operatively attached to the fourth cover shell.

9. The leg guard of claim 1, wherein the strapping system further comprises a thigh strap, the thigh strap comprising a first section having a first width and a second section having a second width, wherein the first section is configured to secure a thigh of a user and the first width is greater than the second width.

10. The leg guard of claim 9, wherein the first width is about 1.5 inches to about 2 inches.

11. A leg guard, comprising:

a toe guard having a first cover shell and a first cushion pad affixed to a bottom side of the first cover shell, a shin guard having a second cover shell and a second cushion pad affixed to a bottom side of the second cover shell, wherein the shin guard is attached to the toe guard by an ankle extension and the shin guard is positioned in vertical alignment with the toe guard, a knee guard having a third cover shell and a third cushion pad affixed to a bottom side of the third cover shell, the third cover shell further comprising an extended left side portion and an extended right side portion, wherein the extended left and right side portions are dimensioned to substantially cover lateral portions of a user's knee, and wherein the knee guard is attached to and positioned in vertical alignment with the shin guard, a thigh guard having a fourth cover shell and a fourth cushion pad affixed to a bottom side of the fourth cover shell, wherein the fourth cover shell comprises a left hinge and a right hinge, the left and right hinges each comprising a first end and a second end, wherein each of the first ends is formed integrally with the fourth cover shell and each of the second ends is removably attached to the third cover shell at a lower pivot point, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, wherein the extended knee guard is attached to the thigh guard by at least two top straps, wherein one end of each top strap is secured to the fourth cover shell and the other end of each top strap is secured between an upper portion of the fifth cover shell and the fifth cushion pad, a strapping system configured to removably and adjustably attach the leg guard to a user, and wherein the knee guard, thigh guard, and extended knee guard are adapted to pivot upon movement of the user through a plurality of positions.

12. The leg guard of claim 11, wherein the extended left and right side portions are configured to form an angle of about 85 degrees to about 100 degrees relative to a front portion of the third cover shell.

13. The leg guard of claim 11, wherein each of the lower pivot points is positioned at an upper edge of the extended left and right side portions of the third cover shell.

14. The leg guard of claim 11, further comprising an inner knee pad detachably and adjustably fastened to a bottom side of the third cushion pad.

15. The leg guard of claim 11, wherein the knee guard, thigh guard, and extended knee guard are adapted to pivot with a change in axial rotation of less than 10 degrees about the user's leg and a change in vertical movement of less than 10 percent about the user's leg from an original position.

16. The leg guard of claim 11, wherein the extended knee guard is attached to the knee guard by at least two bottom straps, wherein one end of each bottom strap is secured to the third cover shell and the other end of each bottom strap is secured between a lower portion of the fifth cover shell and the fifth cushion pad.

17. A leg guard, comprising:

a toe guard having a first cover shell and a first cushion pad affixed to a bottom side of the first cover shell, a shin guard having a second cover shell and a second cushion pad affixed to a bottom side of the second cover shell, wherein the shin guard is attached to the toe guard by an ankle extension and the shin guard is positioned in vertical alignment with the toe guard, a knee guard having a third cover shell and a third cushion pad affixed to a bottom side of the third cover shell, the third cover shell further comprising an extended left side portion and an extended right side portion, wherein the extended left and right side portions are dimensioned to substantially cover lateral portions of a user's knee, and wherein the knee guard is attached to and positioned in vertical alignment with the shin guard, a thigh guard having a fourth cover shell and a fourth cushion pad affixed to a bottom side of the fourth cover shell, wherein the fourth cover shell comprises a left hinge and a right hinge, the left and right hinges each comprising a first end and a second end, wherein each of the first ends is formed integrally with the fourth cover shell and each of the second ends is removably and adjustably attached to the third cover shell at a lower pivot point, wherein the third cover shell comprises at least one slot on each of the extended left and right side portions configured for receiving each of the second ends, an extended knee guard having a fifth cover shell and a fifth cushion pad affixed to a bottom side of the fifth cover shell, wherein the extended knee guard is attached to the knee guard and the thigh guard and is positioned to overlay a portion of the knee guard and a portion of the thigh guard, wherein the extended knee guard is attached to the thigh guard by at least two top straps, wherein one end of each top strap is secured to the fourth cover shell and the other end of each top strap is secured between an upper portion of the fifth cover shell and the fifth cushion pad, a strapping system configured to removably and adjustably attach the leg guard to a user, and wherein the knee guard, thigh guard, and extended knee guard are configured to pivot without a change in axial rotation or vertical displacement upon movement of the user through a plurality of positions.

18. The leg guard of claim 17, wherein the third cover shell comprises a plurality of circular slots on each of the extended left and right side portions configured for receiving each of the second ends.

19. The leg guard of claim 17, wherein the third cover shell comprises an elongated slot on each of the extended left and right side portions configured for adjustably receiving each of the second ends.

20. The leg guard of claim 17, wherein each of the second ends are removably attached by rivets, rubber bushings, pins, t-nuts, screws, binding barrels, bearings, or press fits.

21. The leg guard of claim 17, wherein the left and right hinges are formed from elastomers, cast or injected metal, rubber, carbon fiber, glass composite, co-molded materials, or two-shot injection molded materials.

* * * * *